US008852429B2

(12) United States Patent
Moran et al.

(10) Patent No.: US 8,852,429 B2
(45) Date of Patent: Oct. 7, 2014

(54) METHOD FOR PROCESSING FROTH TREATMENT TAILINGS

(75) Inventors: Kevin Moran, Edmonton (CA); Francis Chachula, Edmonton (CA)

(73) Assignee: Titanium Corporation Inc., Edmonton (CA)

( * ) Notice: Subject to any disclaimer, the term of this patent is extended or adjusted under 35 U.S.C. 154(b) by 1000 days.

(21) Appl. No.: 12/721,991

(22) Filed: Mar. 11, 2010

(65) Prior Publication Data

US 2011/0233115 A1 Sep. 29, 2011

(30) Foreign Application Priority Data

Feb. 22, 2010 (CA) ..... 2693879

(51) Int. Cl.

| | |
|---|---|
| ***C10G 1/04*** | (2006.01) |
| ***B03D 1/14*** | (2006.01) |
| ***B03D 1/24*** | (2006.01) |
| ***C10G 33/06*** | (2006.01) |
| ***B03D 1/02*** | (2006.01) |

(52) U.S. Cl.

CPC *B03D 1/02* (2013.01); *C10G 1/047* (2013.01); *B03D 1/1468* (2013.01); *C10G 2300/44* (2013.01); *B03D 2203/006* (2013.01); *C10G 1/04* (2013.01); *C10G 2300/1033* (2013.01); *B03D 1/247* (2013.01); *C10G 2300/802* (2013.01); *C10G 1/045* (2013.01); *C10G 33/06* (2013.01); *B03D 1/1418* (2013.01); *B03D 1/1462* (2013.01)

USPC ..... 208/390; 208/311; 208/318; 208/321; 208/337

(58) Field of Classification Search

USPC ..... 208/390, 391, 45, 311, 312, 317, 318, 208/321, 337

See application file for complete search history.

(56) References Cited

U.S. PATENT DOCUMENTS

| | | | |
|---|---|---|---|
| 3,656,938 | A | 4/1972 | Penzes |
| 3,990,885 | A | 11/1976 | Baillie et al. |
| 4,138,467 | A | 2/1979 | Kaminsky et al. |
| 4,150,093 | A | 4/1979 | Kaminsky et al. |
| 4,225,422 | A | 9/1980 | Trevoy et al. |
| 5,106,489 | A | 4/1992 | Schmidt et al. |
| 6,074,558 | A | 6/2000 | Duyvesteyn et al. |

(Continued)

FOREIGN PATENT DOCUMENTS

| | | |
|---|---|---|
| CA | 861580 | 1/1971 |
| CA | 879996 | 8/1971 |

(Continued)

OTHER PUBLICATIONS

Oxenford et al, Second International Heavy Minerals Conference, "Heavy Minerals From Alberta Oil Sands—Setting New Standards?", dated Oct. 8, 2003 (22 pages).

*Primary Examiner* — Renee E Robinson

(74) *Attorney, Agent, or Firm* — Terrence N. Kuharchuk; Rodman & Rodman

(57) ABSTRACT

A method for processing froth treatment tailings, including separating the froth treatment tailings in order to produce a coarse mineral material fraction and a fine mineral material fraction therefrom, subjecting the coarse mineral material fraction to froth flotation in order to produce a heavy mineral concentrate and a coarse mineral material tailings therefrom, and subjecting the heavy mineral concentrate to solvent extraction in order to produce a debitumenized heavy mineral concentrate and a bitumen extract therefrom.

56 Claims, 6 Drawing Sheets

(56) References Cited

U.S. PATENT DOCUMENTS

| | | | | |
|---|---|---|---|---|
| 6,207,044 | B1 * | 3/2001 | Brimhall | 208/390 |
| 7,341,658 | B2 | 3/2008 | Reeves | |
| 2007/0187321 | A1 * | 8/2007 | Bjornson et al. | 210/512.3 |
| 2007/0272596 | A1 | 11/2007 | Erasmus et al. | |

FOREIGN PATENT DOCUMENTS

| | | |
|---|---|---|
| CA | 927983 | 6/1973 |
| CA | 1013696 | 7/1977 |
| CA | 1027501 | 3/1978 |
| CA | 1076504 | 4/1980 |
| CA | 1081642 | 7/1980 |
| CA | 1088883 | 11/1980 |
| CA | 1094484 | 1/1981 |
| CA | 1200778 | 2/1986 |
| CA | 1238597 | 6/1988 |
| CA | 1252409 | 4/1989 |
| CA | 1326571 | 1/1994 |
| CA | 2084261 | 2/2000 |
| CA | 2272035 | 3/2004 |
| CA | 2353109 | 12/2005 |
| CA | 2272045 | 11/2006 |
| CA | 2548006 | 11/2007 |
| CA | 2613873 | 10/2008 |
| CA | 2426113 | 5/2009 |
| CA | 1027501 | 6/2010 |

* cited by examiner

| STREAM N0. | 20 | 32 | 30 | 54 | 56 | 58 | 60 |
|---|---|---|---|---|---|---|---|
| STREAM DESCRIPTION | Froth Treatment Tailings | Fine Mineral Material Fraction | Coarse Mineral Material Fraction | Rougher Stage Float Product | Rougher Stage Sink Product | Scavenger Stage Float Product | Scavenger Stage Sink Product |
| | | | | | | | |
| Diluent (kg) | 0.01 | 0.00 | 0.0005 | 0.0003 | 0.0003 | 0.0000 | 0.0002 |
| Bitumen (kg) | 0.10 | 0.0900 | 0.0100 | 0.0098 | 0.0003 | 0.0003 | 0.0000 |
| Water (kg) | 4.05 | 3.92 | 0.1545 | 0.0825 | 0.0720 | 0.0117 | 0.0603 |
| Solid Mineral Material (kg) | 0.85 | 0.49 | 0.3350 | 0.1575 | 0.1775 | 0.0130 | 0.1645 |
| | | | | | | | |
| Total Mass (kg) | 5.01 | 4.50 | 0.5000 | 0.2501 | 0.2501 | 0.0250 | 0.2250 |
| | | | | | | | |
| Diluent to Bitumen Ratio (wt./wt.) | | | | | | | |
| Diluent to Feed Ratio (wt./wt.) | | | | | | | |
| | | | | | | | |
| Diluent (%wt.) | 0.10 | 0.10 | 0.1000 | 0.1000 | 0.1000 | 0.1000 | 0.1000 |
| Bitumen (%wt.) | 2.00 | 2.0000 | 2.0000 | 3.9000 | 0.1000 | 1.0000 | 0.0000 |
| Water (%wt.) | 80.90 | 87.00 | 30.9000 | 33.0000 | 28.8000 | 46.9000 | 26.7889 |
| Solid Mineral Material (%wt.) | 17.00 | 10.90 | 67.0000 | 63.0000 | 71.0000 | 52.0000 | 73.1111 |
| Bitumen (% wt. dry) | | | | | | | |
| | | | | | | | |
| Total (%wt.) | 100.00 | 100.00 | 100.0000 | 100.0000 | 100.0000 | 100.0000 | 100.0000 |
| | | | | | | | |
| Bitumen Recovery (%) | | | | | | | |

Figure 2a

| STREAM N0. | 42 | 97 | 90 | 96 | 94 | 110 | 116 |
|---|---|---|---|---|---|---|---|
| STREAM DESCRIPTION | Heavy Mineral Concentrate | Make-Up Water | First Solvent Extraction Feed Material | First Solvent Extraction Overflow Component | First Solvent Extraction Underflow Component | Second Solvent Extraction Feed Material | Second Solvent Extraction Overflow Component |
| | | | | | | | |
| Diluent (kg) | 0.0003 | 0.0001 | 0.0673 | 0.0554 | 0.0170 | 0.0836 | 0.0670 |
| Bitumen (kg) | 0.0100 | 0.0002 | 0.0119 | 0.0093 | 0.0026 | 0.0027 | 0.0017 |
| Water (kg) | 0.0942 | 0.0597 | 0.1550 | 0.0002 | 0.1497 | 0.1499 | 0.0011 |
| Solid Mineral Material (kg) | 0.1705 | 0.0001 | 0.1708 | 0.0001 | 0.1708 | 0.1708 | 0.0003 |
| | | | | | | | |
| Total Mass (kg) | 0.2750 | 0.0601 | 0.4050 | 0.0650 | 0.3401 | 0.4070 | 0.0701 |
| | | | | | | | |
| Diluent to Bitumen Ratio (wt./wt.) | | | 5.66 | | | 31 | |
| Diluent to Feed Ratio (wt./wt.) | | | 0.17 | | | 0.21 | |
| | | | | | | | |
| Diluent (%wt.) | 0.1000 | 0.1000 | 16.6173 | 85.1962 | 5.0000 | 20.5405 | 96.9464 |
| Bitumen (%wt.) | 3.6364 | 0.3000 | 2.9383 | 14.3538 | 0.7500 | 0.6634 | 2.4286 |
| Water (%wt.) | 34.2636 | 99.5000 | 38.2716 | 0.3500 | 45.5213 | 36.8305 | 0.5000 |
| Solid Mineral Material (%wt.) | 62.0000 | 0.1000 | 42.1728 | 0.1000 | 48.7287 | 41.9656 | 0.1250 |
| Bitumen (% wt. dry) | 5.53 | | 4.76 | | 1.38 | | |
| | | | | | | | |
| Total (%wt.) | 100.0000 | 100.0000 | 100.0000 | 100.0000 | 100.0000 | 100.0000 | 100.0000 |
| | | | | | | | |
| Bitumen Recovery (%) | <100 | | | 93 | | | |

Figure 2b

| STREAM NO. | 114 | 142 | 130 | 136 | 134 | 162 | 160 |
|---|---|---|---|---|---|---|---|
| STREAM DESCRIPTION | Second Solvent Extraction Underflow Component | Addition Amount of Hydrocarbon Diluent | Third Solvent Extraction Feed Material | Third Solvent Extraction Overflow Component | Third Solvent Extraction Underflow Component | Recovered Diluent | Diluent Recovered Debitumenized Heavy Mineral Concentrate |
| | | | | | | | |
| Diluent (kg) | 0.0170 | 0.0700 | 0.0870 | 0.0666 | 0.0204 | 0.0196 | 0.0008 |
| Bitumen (kg) | 0.0009 | 0.0000 | 0.0009 | 0.0002 | 0.0007 | 0.0000 | 0.0006 |
| Water (kg) | 0.1517 | 0.0000 | 0.1517 | 0.0002 | 0.1515 | 0.1363 | 0.0151 |
| Solid Mineral Material (kg) | 0.1705 | 0.0000 | 0.1705 | 0.0001 | 0.1704 | 0.0034 | 0.1670 |
| | | | | | | | |
| Total Mass (kg) | 0.3401 | 0.0700 | 0.4101 | 0.0671 | 0.3430 | 0.1593 | 0.1835 |
| | | | | | | | |
| Diluent to Bitumen Ratio (wt./wt.) | | | 96.7 | | | | |
| Diluent to Feed Ratio (wt./wt.) | | | 0.21 | | | | |
| | | | | | | | |
| Diluent (%wt.) | 5.0000 | 100.0000 | 21.2143 | 99.2548 | 5.9475 | 12.2893 | 0.4359 |
| Bitumen (%wt.) | 0.2500 | 0.0000 | 0.2195 | 0.2981 | 0.2041 | 0.0213 | 0.3270 |
| Water (%wt.) | 44.6044 | 0.0000 | 36.9910 | 0.2981 | 44.1691 | 85.5505 | 8.2289 |
| Solid Mineral Material (%wt.) | 50.1456 | 0.0000 | 41.5752 | 0.1490 | 49.6793 | 2.1389 | 91.0082 |
| Bitumen (% wt. dry) | 0.45 | | | | 0.37 | | 0.36 |
| | | | | | | | |
| Total (%wt.) | 100.0000 | 100.0000 | 100.0000 | 100.0000 | 100.0000 | 100.0000 | 100.0000 |
| | | | | | | | |
| Bitumen Recovery (%) | | | | | | | |

Figure 2c

| Product | Mass (% by weight) | Total Heavy Minerals (THM) (% weight) | | | Hydrocarbons (% by weight) | | | $TiO_2$ (% by weight) | | | $ZrO_2$ (% by weight) | | |
|---|---|---|---|---|---|---|---|---|---|---|---|---|---|
| | | Grade | Rec. | Cum. Rec. | Grade | Rec. | Cum. Rec. | Grade | Rec. | Cum. Rec. | Grade | Rec. | Cum. Rec. |
| Coarse Mineral Material Fraction | 100 | 28.76 | 100 | N/A | 2.59 | 100 | N/A | 9.64 | 100 | N/A | 1.89 | 100 | N/A |
| | | | | | | | | | | | | | |
| Heavy Mineral Concentrate | 43.72 | 64.10 | 97.5 | N/A | 4.84 | 81.6 | N/A | 21.50 | 97.5 | N/A | 4.29 | 99.1 | N/A |
| (Rougher Stage Float Product) | 39.35 | 67.80 | 92.8 | 92.8 | 5.04 | 76.5 | 76.5 | 22.71 | 92.7 | 92.7 | 4.58 | 95.3 | 95.3 |
| (Scavenger Stage Float Product) | 4.37 | 30.80 | 4.7 | 97.5 | 3.02 | 5.1 | 81.6 | 10.60 | 4.8 | 97.5 | 1.66 | 3.8 | 99.1 |
| | | | | | | | | | | | | | |
| Scavenger Stage Sink Product | 56.28 | 1.30 | 2.5 | 100 | 0.85 | 18.4 | 100 | 0.43 | 2.5 | 100 | 0.03 | 0.9 | 100 |
| | | | | | | | | | | | | | |

Figure 3

METHOD FOR PROCESSING FROTH TREATMENT TAILINGS

TECHNICAL FIELD

A process for processing froth treatment tailings in order to produce a debitumenized heavy mineral concentrate and a bitumen extract therefrom.

BACKGROUND OF THE INVENTION

Oil sand is essentially comprised of a matrix of bitumen, solid mineral material and water.

The bitumen component of oil sand includes hydrocarbons which are typically quite viscous at normal in situ temperatures and which act as a binder for the other components of the oil sand. For example, bitumen has been defined by the United Nations Institute for Training and Research as a hydrocarbon with a viscosity greater than $10^4$ mPa s (at deposit temperature) and a density greater than 1000 kg/m$^3$ at 15.6 degrees Celsius.

The solid mineral material component of oil sand typically consists of sand, rock, silt and clay. Solid mineral material may be present in oil sand as coarse mineral material or fine mineral material. The accepted division between coarse mineral material and fine mineral material is typically a particle size of about 44 microns. Solid mineral material having a particle size greater than about 44 microns is typically considered to be coarse mineral material, while solid mineral material having a particle size less than about 44 microns is typically considered to be fine mineral material. Sand and rock are generally present in oil sand as coarse mineral material, while silt and clay are generally present in oil sand as fine mineral material.

A typical deposit of oil sand may contain (by weight) about 10 percent bitumen, up to about 6 percent water, with the remainder being comprised of solid mineral material, which may include a relatively small amount of impurities such as humic matter and heavy minerals.

Water based technologies are typically used to extract bitumen from oil sand ore originating from the Athabasca area in northeastern Alberta, Canada. A variety of water based technologies exist, including the Clark "hot water" process and a variety of other processes which may use hot water, warm water or cold water in association with a variety of different separation apparatus.

In a typical water based oil sand extraction process, the oil sand ore is first mixed with water to form an aqueous slurry. The slurry is then processed to release bitumen from within the oil sand matrix and prepare the bitumen for separation from the slurry, thereby providing a conditioned slurry. The conditioned slurry is then processed in one or more separation apparatus which promote the formation of a primary bitumen froth while rejecting coarse mineral material and much of the fine mineral material and water. The separation apparatus may also produce a middlings stream from which a secondary bitumen froth may be scavenged. This secondary bitumen froth may be added to the primary bitumen froth or may be kept separate from the primary bitumen froth.

A typical bitumen froth (comprising a primary bitumen froth and/or a secondary bitumen froth) may contain (by weight) about 60 percent bitumen, about 30 percent water and about 10 percent solid mineral material, wherein a large proportion of the solid mineral material is fine mineral material. The bitumen which is present in a typical bitumen froth is typically comprised of both non-asphaltenic material and asphaltenes.

This bitumen froth is typically subjected to a froth treatment process in order to reduce its solid mineral material and water concentration by separating the bitumen froth into a bitumen product and froth treatment tailings.

In a typical froth treatment process, the bitumen froth is diluted with a froth treatment diluent to provide a density gradient between the hydrocarbon phase and the water phase and to lower the viscosity of the hydrocarbon phase. The diluted bitumen froth is then subjected to separation in one or more separation apparatus in order to produce the bitumen product and the froth treatment tailings. Exemplary separation apparatus include gravity settling vessels, inclined plate separators and centrifuges.

Some commercial froth treatment processes use naphthenic type diluents (defined as froth treatment diluents which consist essentially of or contain a significant amount of one or more aromatic compounds). Examples of naphthenic type diluents include toluene (a light aromatic compound) and naphtha, which may be comprised of both aromatic and non-aromatic compounds.

Other commercial froth treatment processes use paraffinic type diluents (defined as froth treatment diluents which consist essentially of or contain significant amounts of one or more relatively short-chained aliphatic compounds). Examples of paraffinic type diluents are C4 to C8 aliphatic compounds and natural gas condensate, which typically contains short-chained aliphatic compounds and may also contain small amounts of aromatic compounds.

Froth treatment processes which use naphthenic type diluents (i.e., naphthenic froth treatment processes) typically result in a relatively high bitumen recovery (perhaps about 98 percent), but also typically result in a bitumen product which has a relatively high solid mineral material and water concentration.

Froth treatment processes which use paraffinic type diluents (i.e., paraffinic froth treatment processes) typically result in a relatively lower bitumen recovery (in comparison with naphthenic froth treatment processes), and in a bitumen product which has a relatively lower solid mineral material and water concentration (in comparison with naphthenic froth treatment processes). Both the relatively lower bitumen recovery and the relatively lower solid mineral material and water concentration may be attributable to the phenomenon of asphaltene precipitation, which occurs in paraffinic froth treatment processes when the concentration of the paraffinic type diluent exceeds a critical level. This asphaltene precipitation results in bitumen being lost to the froth treatment tailings, but also provides a cleaning effect in which the precipitating asphaltenes trap solid mineral material and water as they precipitate, thereby separating the solid mineral material and the water from the bitumen froth.

Froth treatment tailings therefore typically contain solid mineral material, water, froth treatment diluent, and small amounts of residual bitumen (perhaps about 2-12 percent of the bitumen which was contained in the original bitumen froth, depending upon whether the froth treatment process uses a naphthenic type diluent or a paraffinic type diluent).

Much of the froth treatment diluent is typically recovered from the froth treatment tailings in a tailings solvent recovery unit (TSRU). The froth treatment tailings (including the tailings bitumen) are then typically disposed of in a tailings pond.

A significant amount of bitumen from the original oil sand ore is therefore typically lost to the froth treatment tailings as residual bitumen. There are both environmental incentives and economic incentives for recovering all or a portion of this residual bitumen.

In addition, the solid mineral material which is included in the froth treatment tailings comprises an amount of heavy minerals. Heavy minerals are typically considered to be solid mineral material which has a specific gravity greater than that of quartz (i.e., a specific gravity greater than about 2.65). The heavy minerals in the solid mineral material which is contained in typical froth treatment tailings may include titanium metal minerals such as rutile ($TiO_2$), anatase ($TiO_2$), ilmenite ($FeTiO_3$) and leucoxene (typically an alteration product of ilmenite) and zirconium metal minerals such as zircon ($ZrSiO_4$). Titanium and zirconium bearing minerals are typically used as feedstocks for manufacturing engineered materials due to their inherent properties.

Although oil sand ore may contain a relatively low concentration of heavy minerals, it is known that these heavy minerals tend to concentrate in the bitumen froth which is extracted from the oil sand ore, and therefore become concentrated in the froth treatment tailings which result from froth treatment processes, primarily as coarse mineral material. As a result, froth treatment tailings may typically contain a sufficient concentration of heavy minerals to provide an economic incentive to recover these heavy minerals from the froth treatment tailings.

The prior art includes attempts to recover heavy minerals from oil sand and attempts to recover bitumen from oil sand tailings.

Canadian Patent No. 861,580 (Bowman) describes a process for the recovery of heavy metals from a primary bitumen froth. Canadian Patent No. 879,996 (Bowman) describes a process for the recovery of heavy metals from a secondary bitumen froth. Canadian Patent No. 927,983 (Penzes) describes a process for the recovery of heavy metal materials from primary bitumen froth. Canadian Patent No. 1,013,696 (Baillie et al) describes a process for producing from froth treatment tailings a quantity of heavy metal compounds such as titanium and zirconium minerals which are substantially free of bitumen and other hydrocarbon substances. Canadian Patent No. 1,076,504 (Kaminsky et al) describes a process for concentrating and recovering titanium and zirconium containing minerals from froth treatment tailings. Canadian Patent No. 1,088,883 (Trevoy et al) describes a dry separatory process for concentrating titanium-based and zirconium-based minerals from first stage centrifuge froth treatment tailings. Canadian Patent No. 1,326,571 (Ityokumbul et al) describes a process for recovering metal values such as titanium and zirconium from froth treatment tailings. Canadian Patent No. 2,426,113 (Reeves et al) describes a process for recovering heavy minerals from froth treatment tailings. Canadian Patent Application No. 2,548,006 (Erasmus et al) describes a process for recovering heavy minerals from froth treatment tailings.

Canadian Patent No. 1,081,642 (Porteous et al) and Canadian Patent No. 1,094,484 (Porteous et al) both describes processes for recovering bitumen from froth treatment tailings. Canadian Patent No. 1,238,597 (Seitzer) describes a process for the recovery of diluent and bitumen from the predominantly aqueous phase of electrostatically treated froth treatment tailings. Canadian Patent No. 1,252,409 (St. Amour et al) describes a method for recovering bitumen from a waste sludge obtained from a retention pond used to store tailings from water extraction of bitumen from tar sands.

None of the above prior art processes are directed at processing froth treatment tailings in order to produce a debitumenized heavy mineral concentrate and a bitumen extract therefrom.

SUMMARY OF THE INVENTION

References in this document to orientations, to operating parameters, to ranges, to lower limits of ranges, and to upper limits of ranges are not intended to provide strict boundaries for the scope of the invention, but should be construed to mean "approximately" or "about" or "substantially", within the scope of the teachings of this document, unless expressly stated otherwise.

In this document, "gravity settling" means an operation in which components of a mixture are separated using gravity, and is therefore distinguished from other separation operations such as molecular sieve processes, absorption processes, adsorption processes, magnetic processes, electrical processes, enhanced gravity settling processes, etc.

In this document, "gravity settler" includes a gravity settling vessel, an inclined plate separator, a rotary disc contactor, a thickener, and any other suitable apparatus which facilitates gravity settling, with or without the use of process aids such as flocculants and demulsifiers.

In this document, "gravity settling vessel" means a tank or other vessel into which a mixture may be introduced in order to facilitate separation of the mixture using gravity, but is distinguishable from an inclined plate separator. A gravity settling vessel may have any shape, size and/or configuration which is suitable for achieving gravity separation. A gravity settling vessel may or may not include internal structures such as weirs, sumps, launders, baffles, distributors, etc. and may or may not include internal mechanical devices such as rakes, conveyors, augers, etc.

In this document, "inclined plate separator" means an apparatus which is comprised of a plurality of stacked inclined plates onto which a mixture to be separated may be introduced so that the mixture passes along the plates in order to achieve separation of components of the mixture, and is distinguishable from a gravity settling vessel.

In this document, "enhanced gravity separation" means an operation in which components of a mixture are separated using centrifugal acceleration or centripetal acceleration resulting from rotational movement of the mixture, and is therefore distinguished from gravity separation processes.

In this document, "enhanced gravity separator" or "enhanced gravity separation apparatus" includes a centrifuge, a hydrocyclone and any other suitable apparatus which facilitates enhanced gravity separation.

In this document, "solvent extraction" means an operation in which components of a mixture are separated by adding to the mixture a suitable liquid solvent which dissolves and/or dilutes one or more components of the mixture, thereby facilitating separation of components of the mixture.

In this document, "solvent extraction apparatus" includes gravity settlers (including without limitation, gravity settling vessels, inclined plate separators, and rotary disc contactors) and enhanced gravity separators (including without limitation, centrifuges and hydrocyclones).

In this document, "froth treatment diluent" means any substance containing one or more hydrocarbon compounds and/or substituted hydrocarbon compounds which is suitable for use in diluting and/or dissolving bitumen froth in a froth treatment process.

In this document, "hydrocarbon diluent" means any substance containing one or more hydrocarbon compounds and/or substituted hydrocarbon compounds which is suitable for use for diluting and/or dissolving bitumen in the practice of the invention.

In this document, "diluent" may include a froth treatment diluent and/or a hydrocarbon diluent.

In this document, "naphthenic type diluent" means a froth treatment diluent or a hydrocarbon diluent which includes a sufficient amount of one or more aromatic compounds so that the diluent essentially exhibits the properties of a naphthenic type diluent as recognized in the art, as distinguished from a paraffinic type diluent. In this document, a naphthenic type diluent may therefore be comprised of a mixture of aromatic and non-aromatic compounds, including but not limited to such substances as naphtha and toluene.

In this document, "naphthenic froth treatment process" means a froth treatment process which uses a sufficient amount of one or more naphthenic type diluents so that the froth treatment process is recognized in the art as a naphthenic froth treatment process as distinguished from a paraffinic froth treatment process.

In this document, "paraffinic type diluent" means a froth treatment diluent or a hydrocarbon diluent which includes a sufficient amount of one or more relatively short-chain aliphatic compounds (such as, for example, C5 to C8 aliphatic compounds) so that the diluent essentially exhibits the properties of a paraffinic type diluent as recognized in the art, as distinguished from a naphthenic type diluent. In this document, a paraffinic type diluent may therefore be comprised of a mixture of aliphatic and non-aliphatic compounds, including but not limited to such substances as natural gas condensate.

In this document, "paraffinic froth treatment process" means a froth treatment process which uses a sufficient amount of one or more paraffinic type diluents so that the froth treatment process is recognized in the art as a paraffinic froth treatment process as distinguished from a naphthenic froth treatment process.

In this document, "froth flotation" means an operation in which components of a mixture are separated by passing a gas through the mixture so that the gas causes one or more components of the mixture to float to the top of the mixture and form a froth. In this document, froth flotation may be performed using flotation cells or tanks, flotation columns or any other suitable froth flotation apparatus, which may or may not include agitators or mixers, and froth flotation may include the use of flotation aids, including without limitation, surfactants and frothing agents.

The present invention is a method for processing froth treatment tailings comprising solid mineral material, water and bitumen, wherein the froth treatment tailings result from a process for recovering bitumen from oil sand, wherein the process for recovering bitumen from oil sand is comprised of producing a bitumen froth from the oil sand, and wherein the process for recovering bitumen from oil sand is further comprised of separating the froth treatment tailings from the bitumen froth in a froth treatment process.

The method results in the production from the froth treatment tailings of a debitumenized heavy mineral concentrate and a bitumen extract. In some embodiments, the composition and/or properties of the debitumenized heavy mineral concentrate facilitate subsequent separation of heavy minerals from the debitumenized heavy mineral concentrate. In some embodiments, the composition and/or properties of the bitumen extract facilitate transportation and/or upgrading of the bitumen extract without further processing.

The froth treatment tailings may be comprised of an amount of a froth treatment diluent which is present as a result of separating the froth treatment tailings from the bitumen froth. Alternatively, the froth treatment tailings may contain little or no froth treatment diluent, either because the froth treatment diluent has been recovered from the froth treatment tailings in a tailings solvent recovery unit (TSRU) process or a similar process or because the separation of the froth treatment tailings from the bitumen froth has not required the use of a froth treatment diluent.

Where the froth treatment tailings are comprised of a froth treatment diluent, the froth treatment diluent may be comprised of a naphthenic type diluent and/or a paraffinic type diluent, depending upon the type of froth treatment process from which the froth treatment tailings were obtained.

Although the froth treatment tailings may be obtained from a paraffinic froth treatment process so that the froth treatment tailings may be comprised of a paraffinic type diluent as a froth treatment diluent, the method of the invention may be more readily suited for processing froth treatment tailings which have been produced by a naphthenic froth treatment process than for processing froth treatment tailings which have been produced by a paraffinic froth treatment process.

A reason for this is that froth treatment tailings from a paraffinic froth treatment process may typically contain relatively larger amounts of bitumen than froth treatment tailings from a naphthenic froth treatment process. In addition, the bitumen contained in froth treatment tailings from a paraffinic froth treatment process typically includes a relatively large proportion of asphaltenes.

The amount and nature of the bitumen which is typically contained in froth treatment tailings from a paraffinic froth treatment process presents processing challenges which may require more aggressive and/or rigorous process conditions within the scope of the method when processing froth treatment tailings from a paraffinic froth treatment process than when processing froth treatment tailings from a naphthenic froth treatment process.

In a first exemplary aspect, the invention is a method for processing froth treatment tailings comprising solid mineral material, water, and bitumen, wherein the froth treatment tailings result from a process for recovering bitumen from oil sand, wherein the process for recovering bitumen from oil sand is comprised of producing a bitumen froth from the oil sand, wherein the process for recovering bitumen from oil sand is further comprised of separating the froth treatment tailings from the bitumen froth in a froth treatment process, the method comprising:

(a) separating the froth treatment tailings in order to produce a coarse mineral material fraction and a fine mineral material fraction therefrom;
(b) subjecting the coarse mineral material fraction to froth flotation in order to produce a heavy mineral concentrate and a coarse mineral material tailings therefrom; and
(c) subjecting the heavy mineral concentrate to solvent extraction in order to produce a debitumenized heavy mineral concentrate and a bitumen extract therefrom.

The coarse mineral material fraction comprises a minimal amount of solid mineral material having a particle size less than about 44 microns. The fine mineral material fraction comprises a minimal amount of solid mineral material having a particle size greater than about 44 microns.

A purpose of separating the froth treatment tailings is to provide a conditioned feed material for the froth flotation. More particularly, separating the froth treatment tailings in order to produce the coarse mineral material fraction and the fine mineral material fraction therefrom results in amounts of slimes (i.e., fine mineral material) and free bitumen reporting to the fine mineral material fraction so that they are diverted from the coarse mineral material fraction. These slimes and free bitumen can decrease the flotation response of the heavy minerals, destabilize the froth, and result in poor flotation recovery of the heavy minerals. Separating the froth treatment tailings to produce the coarse mineral material fraction and the fine mineral material fraction may therefore be referred to as "desliming" the froth treatment tailings.

Separating the froth treatment tailings to produce the coarse mineral material fraction and the fine mineral material fraction may be performed in any manner. As non-limiting examples, the froth treatment tailings may be separated to produce the coarse mineral material fraction and the fine mineral material fraction by gravity settling and/or by enhanced gravity separation.

In some embodiments, the froth treatment tailings may be separated to produce the coarse mineral material fraction and the fine mineral material fraction by enhanced gravity separation. In some embodiments, separating the froth treatment tailings to produce the coarse mineral material fraction and the fine mineral material fraction may be comprised of passing the froth treatment tailings through a tailings separation enhanced gravity separation apparatus. In some embodiments, the tailings separation enhanced gravity separation apparatus may be comprised of a hydrocyclone.

A purpose of subjecting the coarse mineral material fraction to froth flotation is to concentrate the heavy minerals contained in the coarse mineral material fraction, thereby producing the heavy mineral concentrate. Concentrating the heavy minerals in the heavy mineral concentrate reduces the amount of feed material which must subsequently be processed in order to recover the heavy minerals.

Subjecting the coarse mineral material fraction to froth flotation may be performed in any manner which is effective to produce the heavy mineral concentrate and the coarse mineral material tailings therefrom.

The froth flotation is performed so that the heavy mineral concentrate is comprised of a high proportion of the heavy minerals which are contained in the coarse mineral material fraction (particularly the titanium metal minerals and the zirconium metal minerals contained therein), and is performed so that the coarse mineral material tailings are comprised of a low proportion of the heavy minerals which are contained in the coarse mineral material fraction. The coarse mineral material tailings may typically be comprised of a high proportion of quartz and other solid mineral material which are not considered to be heavy minerals.

In some embodiments, the froth flotation is also performed so that the heavy mineral concentrate is comprised of a high proportion of the bitumen which is contained in the coarse mineral material fraction, and is performed so that the coarse mineral material tailings are comprised of a low proportion of the bitumen which is contained in the coarse mineral material fraction.

The froth flotation may be comprised of adding an amount of a frothing agent to the coarse mineral material fraction and passing a gas such as air through the coarse mineral material fraction. The frothing agent may be comprised of any suitable substance or combination of substances. In some embodiments, the frothing agent may be comprised of or may consist essentially of a glycol based frother. In some embodiments, the frothing agent may be comprised of or may consist essentially of an alcohol based frother. In some embodiments, a suitable glycol based frother may be Cytec™ F-507 frother, a product of Cytec Industries Inc.

The concentration of the frothing agent in the feed material which is being subjected to the froth flotation may be any concentration which is suitable for encouraging the formation of a froth layer. In some embodiments, the concentration of the frothing agent in the feed material may be less than or equal to about 200 grams of frothing agent per tonne of solid mineral material which is included in the feed material. In some embodiments, the concentration of the frothing agent in the feed material may be less than or equal to about 100 grams per tonne of solid mineral material which is included in the feed material. In some embodiments, the concentration of the frothing agent in the feed material may be between about 15 grams and about 50 grams per tonne of solid mineral material which is included in the feed material.

In some embodiments, the suitable concentration of the frothing agent in the feed material may be dependent upon the amount of bitumen which is contained in the feed material. More particularly, higher amounts of bitumen in the feed material may suggest higher suitable concentrations of the frothing agent in the feed material.

The coarse mineral material fraction has a solid mineral material concentration. The solid mineral material fraction may have any solid mineral material concentration which is suitable for conducting the froth flotation. In some embodiments, the coarse mineral material fraction may have a solid mineral material concentration of at least about 20 percent by weight of the coarse mineral material fraction when the coarse mineral material fraction is introduced to the froth flotation. In some embodiments, the coarse mineral material fraction may have a solid mineral material concentration of between about 20 percent and about 80 percent by weight of the coarse mineral material fraction when the coarse mineral material fraction is introduced to the froth flotation.

In some embodiments, subjecting the coarse mineral material fraction to froth flotation is comprised of producing the heavy mineral concentrate as a froth flotation float product and producing the coarse mineral material tailings as a froth flotation sink product.

The froth flotation may be comprised of a single stage of froth flotation or the froth flotation may be comprised of a plurality of stages of froth flotation.

In some embodiments, the froth flotation may be performed in a flotation apparatus which may be comprised of one or more flotation vessels. In some embodiments, the flotation apparatus may be comprised of a plurality of flotation vessels which may be arranged in a parallel configuration and/or in a series configuration.

In some embodiments, the froth flotation may be comprised of a rougher froth flotation stage and a scavenger froth flotation stage. In some embodiments, subjecting the coarse mineral material fraction to froth flotation may be comprised of subjecting the coarse mineral material fraction to the rougher froth flotation stage in order to produce a rougher stage float product and a rougher stage sink product, and may be further comprised of subjecting the rougher stage sink product to the scavenger froth flotation stage in order to produce a scavenger stage float product and a scavenger stage sink product.

In some embodiments, the heavy mineral concentrate may be comprised of the rougher stage float product and the scavenger stage float product, and the method may be further comprised of combining the rougher stage float product and the scavenger stage float product to provide the heavy mineral concentrate. In some embodiments, the heavy mineral concentrate may consist essentially of the rougher stage float product and the scavenger stage float product. In some embodiments, the coarse mineral material tailings may be comprised of or may consist essentially of the scavenger stage sink product.

In some embodiments, subjecting the rougher stage sink product to the scavenger froth flotation stage may be comprised of adding an amount of a collector to the rougher stage sink product to enhance the recovery of heavy minerals from the rougher stage sink product in the scavenger froth flotation stage.

The collector may be comprised of any suitable substance or combination of substances. In some embodiments, the collector may be comprised of a relatively low molecular weight hydrocarbon compound or a combination of relatively low molecular weight hydrocarbon compounds. In some embodiments, the collector may be comprised of a hydrocarbon liquid. In some embodiments, the hydrocarbon liquid may be selected from the group of hydrocarbon liquids consisting of kerosene, naphtha, and combinations thereof.

The concentration of the collector in the rougher stage sink product may be any concentration which is suitable for collecting the heavy minerals which are contained in the rougher stage sink product without interfering significantly with the production of the froth layer in the scavenger froth flotation stage. In some embodiments, the concentration of the collector in the rougher stage sink product may be less than or equal to about 10 liters per tonne of solid mineral material which is included in the rougher stage sink product. In some embodiments, the concentration of the collector in the rougher stage sink product may be less than or equal to about 1 liter per tonne of solid mineral material which is included in the rougher stage sink product.

In some embodiments, the froth flotation may be comprised of a rougher froth flotation stage and a cleaner froth flotation stage. In some embodiments, subjecting the coarse mineral material fraction to froth flotation may be comprised of subjecting the coarse mineral material fraction to the rougher froth flotation stage in order to produce a rougher stage float product and a rougher stage sink product, and may be further comprised of subjecting the rougher stage float product to the cleaner froth flotation stage in order to produce a cleaner stage float product and a cleaner stage sink product.

In some embodiments, the heavy mineral concentrate may be comprised of the cleaner stage float product. In some embodiments, the heavy mineral concentrate may consist essentially of the cleaner stage float product. In some embodiments, the coarse mineral material tailings may be comprised of or may consist essentially of the rougher stage sink product and the scavenger stage sink product.

A purpose of subjecting the heavy mineral concentrate to solvent extraction is to reduce the amount of bitumen which is contained in the heavy mineral concentrate, thereby producing the debitumenized heavy mineral concentrate and the bitumen extract. Without the solvent extraction, the presence of more than a minimal amount of bitumen in the heavy mineral concentrate may interfere with subsequent processing to recover the heavy minerals from the heavy mineral concentrate.

Subjecting the heavy mineral concentrate to solvent extraction may be performed in any manner which is effective to produce the debitumenized heavy mineral concentrate and the bitumen extract. The debitumenized heavy mineral concentrate contains less bitumen than the heavy mineral concentrate and is therefore "debitumenized" relative to the heavy mineral concentrate.

The solvent extraction is comprised of separating the heavy mineral concentrate in order to produce the debitumenized heavy mineral concentrate and the bitumen extract.

In some embodiments, the solvent extraction may be further comprised of attritioning the heavy mineral concentrate prior to separating the heavy mineral concentrate in order to enhance the separating of the heavy mineral concentrate by assisting in liberating the bitumen from the heavy mineral concentrate. In some embodiments, attritioning the heavy mineral concentrate may be comprised of or may consist essentially of mixing the heavy mineral concentrate.

The solvent extraction may be performed using a diluent as a solvent. The diluent may be comprised of a hydrocarbon diluent which is introduced to the solvent extraction and/or the diluent may be comprised of residual froth treatment diluent which is contained in the froth treatment tailings as a result of the froth treatment process.

The diluent may be comprised of or may consist essentially of one or more suitable naphthenic type diluents or may be comprised of a mixture of one or more suitable naphthenic type diluents and/or paraffinic type diluents. The amount of the diluent may be any amount which is effective to facilitate the separation of the heavy mineral concentrate in order to produce the debitumenized heavy mineral concentrate and the bitumen extract.

In some embodiments in which the diluent may be comprised of a paraffinic type diluent, the paraffinic type diluent may be present in the diluent as a residual amount of a froth treatment diluent which was contained in the froth treatment tailings as a result of a paraffinic froth treatment process. In some embodiments in which the diluent may consist essentially of one or more naphthenic type diluents, some of the naphthenic type diluent may be present in the diluent as a residual amount of a froth treatment diluent which was contained in the froth treatment tailings as a result of a naphthenic froth treatment process.

In some embodiments in which the diluent may be comprised of a paraffinic type diluent, the amount of the paraffinic type diluent may be selected in order to control the amount of asphaltenes which are precipitated during the solvent extraction, since precipitated asphaltenes will tend to be included in the debitumenized heavy mineral concentrate and not in the bitumen extract. An excessive amount of precipitated asphaltenes contained in the debitumenized heavy mineral concentrate may interfere with subsequent processing to recover the heavy minerals from the debitumenized heavy mineral concentrate.

In some embodiments in which the diluent may be comprised of a naphthenic type diluent, a suitable diluent may be comprised of or may consist essentially of naphtha or toluene. In some embodiments, the diluent may be comprised of or may consist essentially of naphtha.

The amount of the diluent may be any amount which is suitable for conducting the solvent extraction. In some embodiments in which the diluent may be comprised of a naphthenic type diluent, the amount of the diluent may be selected in order to maximize the separation of the heavy mineral concentrate into the debitumenized heavy mineral concentrate and the bitumen extract. In some embodiments in which the diluent may be comprised of a naphthenic type diluent, the amount of the diluent may be selected to be at least about 15 percent by weight of the feed material which is being subjected to the solvent extraction.

Attritioning the heavy mineral concentrate in the solvent extraction may be performed in any manner which is effective to assist in liberating bitumen from the heavy mineral concentrate. In some embodiments, attritioning the heavy mineral concentrate may be comprised of mixing the heavy mineral concentrate in a mixing apparatus.

The heavy mineral concentrate has a solid mineral material concentration. The heavy mineral concentrate may have any solid mineral material concentration which is suitable for conducting the solvent extraction. In some embodiments, the heavy mineral concentrate may have a solid mineral material concentration which is lower than a solid mineral material concentration which will interfere with the recovery of the bitumen extract from the heavy mineral concentrate. In some embodiments, the heavy mineral concentrate may have a solid mineral material concentration of at least about 20 percent by weight of the heavy mineral concentrate when it is introduced to the solvent extraction. In some embodiments, the heavy mineral concentrate may have a solid mineral material concentration of less than or equal to about 80 percent by weight of the heavy mineral concentrate when it is introduced to the solvent extraction. In some embodiments, the heavy mineral concentrate may have a solid mineral material concentration of less than or equal to about 70 percent by weight of the heavy mineral concentrate when it is introduced to the solvent extraction. In some embodiments, the heavy mineral concentrate may have a solid mineral material concentration of between about 20 percent and 70 percent by weight of the heavy mineral concentrate when it is introduced to the solvent extraction.

Separating the heavy mineral concentrate in the solvent extraction may be performed in any manner which is effective to separate the heavy mineral concentrate to produce the debitumenized heavy mineral concentrate and the bitumen extract. In some embodiments, separating the heavy mineral concentrate may be comprised of subjecting the heavy mineral concentrate to gravity settling and/or enhanced gravity separation. In some embodiments, subjecting the heavy mineral concentrate to gravity settling and/or enhanced gravity separation may be comprised of passing the heavy mineral concentrate through one or more gravity settlers and/or one or more enhanced gravity separation apparatus. In some embodiments, the one or more gravity settlers may be comprised of one or more gravity settling vessels.

In some embodiments, the solvent extraction may be further comprised of combining a recycled amount of a solvent extraction intermediate component which is derived from the separating of the heavy mineral concentrate with the feed material for the solvent extraction so that the feed material for the solvent extraction is further comprised of the recycled amount of the solvent extraction intermediate component. A purpose of combining the recycled amount of the solvent extraction intermediate component with the feed material for the solvent extraction is to dilute the feed material in order to enhance the separating of the feed material.

The solvent extraction may be comprised of a single stage of solvent extraction or the solvent extraction may be comprised of a plurality of stages of solvent extraction. A plurality of stages of solvent extraction may be comprised of a plurality of stages of separating. The plurality of stages of separating may be comprised of gravity settling, enhanced gravity separation, or a combination of gravity settling and enhanced gravity separation and may be comprised of passing the heavy mineral concentrate and/or a feed material derived therefrom through one or more gravity settlers, enhanced gravity separation apparatus, or a combination of gravity settlers and enhanced gravity separation apparatus.

A plurality of stages of solvent extraction may be comprised of a single stage of attritioning or a plurality of stages of attritioning. In some embodiments, each stage in a plurality of stages of solvent extraction may be comprised of attritioning and separating.

In some embodiments, the heavy mineral concentrate will become more "debitumenized" as the number of stages of solvent extraction increases, so that the heavy mineral concentrate is progressively cleaned of bitumen by the stages of solvent extraction. In such embodiments, the number of stages of solvent extraction may be selected so that the bitumen concentration of the debitumenized heavy mineral concentrate is no greater than a desired limit which will facilitate subsequent processing of the debitumenized heavy mineral concentrate to recover the heavy minerals therefrom.

In some embodiments, the desired limit of the bitumen concentration of the debitumenized heavy mineral concentrate may be about 0.5 percent bitumen by weight of the debitumenized heavy mineral concentrate.

In some embodiments in which the solvent extraction may be comprised of a plurality of stages of solvent extraction, the stages of solvent extraction may be arranged in a co-current configuration or may be arranged in a countercurrent configuration.

In some embodiments, the solvent extraction may be comprised of a first solvent extraction stage. In some embodiments, the first solvent extraction stage may be comprised of attritioning a first solvent extraction feed material in order to produce an attritioned first solvent extraction feed material. In some embodiments, the first solvent extraction stage may be further comprised of separating the attritioned first solvent extraction feed material in order to produce a first solvent extraction underflow component and a first solvent extraction overflow component. The first solvent extraction feed material may be comprised of the heavy mineral concentrate. The first solvent extraction feed material may include a first stage amount of a diluent.

In some embodiments, attritioning the first solvent extraction feed material in the first solvent extraction stage may be comprised of mixing the first solvent extraction feed material in a first mixing apparatus.

In some embodiments, separating the attritioned first solvent extraction feed material in the first solvent extraction stage may be comprised of passing the attritioned first solvent extraction feed material through a first gravity settler. In some embodiments, the first gravity settler may be comprised of a first gravity settling vessel.

The first solvent extraction feed material has a solid mineral material concentration. The first solvent extraction feed material may have any solid mineral material concentration which is suitable for conducting the first solvent extraction stage. In some embodiments, the first solvent extraction feed material may have a solid mineral material concentration which is lower than a solid mineral material concentration which will interfere with the separation of bitumen from the first solvent extraction feed material. In some embodiments, the first solvent extraction feed material may have a solid mineral material concentration of at least about 20 percent by weight of the first solvent extraction feed material. In some embodiments, the first solvent extraction feed material may have a solid mineral material concentration of less than or equal to about 80 percent by weight of the first solvent extraction feed material. In some embodiments, the first solvent extraction feed material may have a solid mineral material concentration of less than or equal to about 70 percent by weight of the first solvent extraction feed material. In some embodiments, the first solvent extraction feed material may have a solid mineral material concentration of between about 20 percent and 70 percent by weight of the first solvent extraction feed material.

In some embodiments, the diluent may be comprised of or may consist essentially of a naphthenic type diluent such as naphtha and the first stage amount of the diluent may be at least about 15 percent by weight of the first solvent extraction feed material.

In some embodiments, the solvent extraction may consist essentially of the first solvent extraction stage. In such embodiments, the debitumenized heavy mineral concentrate may be comprised of or may consist essentially of the first solvent extraction underflow component and the bitumen extract may be comprised of or may consist essentially of the first solvent extraction overflow component.

In some embodiments, the first solvent extraction stage may be further comprised of combining a recycled amount of a first solvent extraction intermediate component which is derived from the separating of the attritioned first solvent extraction feed material with the first solvent extraction feed material so that the first solvent extraction feed material is further comprised of the recycled amount of the first solvent extraction intermediate component.

In some embodiments, the solvent extraction may be further comprised of a second solvent extraction stage. In some embodiments, the second solvent extraction stage may be comprised of attritioning a second solvent extraction feed material in order to produce an attritioned second solvent extraction feed material. In some embodiments, the second solvent extraction stage may be further comprised of separating the attritioned second solvent extraction feed material in order to produce a second solvent extraction underflow component and a second solvent extraction overflow component. The second solvent extraction feed material may be comprised of the first solvent extraction underflow component. The first solvent extraction feed material may include a second stage amount of a diluent.

In some embodiments, attritioning the second solvent extraction feed material in the second solvent extraction stage may be comprised of mixing the second solvent extraction feed material in a second mixing apparatus.

In some embodiments, separating the attritioned second solvent extraction feed material in the second solvent extraction stage may be comprised of passing the attritioned second solvent extraction feed material through a second gravity settler. In some embodiments, the second gravity settler may be comprised of a second gravity settling vessel.

The second solvent extraction feed material has a solid mineral material concentration. The second solvent extraction feed material may have any solid mineral material concentration which is suitable for conducting the second solvent extraction stage. In some embodiments, the second solvent extraction feed material may have a solid mineral material concentration which is lower than a solid mineral material concentration which will interfere with the separation of bitumen from the second solvent extraction feed material. In some embodiments, the second solvent extraction feed material may have a solid mineral material concentration of at least about 20 percent by weight of the second solvent extraction feed material. In some embodiments, the second solvent extraction feed material may have a solid mineral material concentration of less than or equal to about 80 percent by weight of the second solvent extraction feed material. In some embodiments, the second solvent extraction feed material may have a solid mineral material concentration of less than or equal to about 70 percent by weight of the second solvent extraction feed material. In some embodiments, the second solvent extraction feed material may have a solid mineral material concentration of between about 20 percent and 70 percent by weight of the second solvent extraction feed material.

In some embodiments, the diluent may be comprised of or may consist essentially of a naphthenic type diluent such as naphtha and the second stage amount of the diluent may be at least about 15 percent by weight of the second solvent extraction feed material.

In some embodiments, the solvent extraction may consist essentially of the first solvent extraction stage and the second solvent extraction stage. In such embodiments, the debitumenized heavy mineral concentrate may be comprised of or may consist essentially of the second solvent extraction underflow component. In such embodiments, the bitumen extract may be comprised of or may consist essentially of the first solvent extraction overflow component and/or the second solvent extraction overflow component.

In some embodiments, the first solvent extraction stage and the second solvent extraction stage may be arranged in a countercurrent configuration. In such embodiments, the bitumen extract may be comprised of or may consist essentially of the first solvent extraction overflow component. In such embodiments, the first solvent extraction feed material may be further comprised of the second solvent extraction overflow component.

In some embodiments, the second solvent extraction stage may be further comprised of combining a recycled amount of a second solvent extraction intermediate component which is derived from the separating of the attritioned second solvent extraction feed material with the second solvent extraction feed material so that the second solvent extraction feed material is further comprised of the recycled amount of the second solvent extraction intermediate component.

In some embodiments, the solvent extraction may be further comprised of a third solvent extraction stage. In some embodiments, the third solvent extraction stage may be comprised of attritioning a third solvent extraction feed material in order to produce an attritioned third solvent extraction feed material. In some embodiments, the third solvent extraction stage may be further comprised of separating the attritioned third solvent extraction feed material in order to produce a third solvent extraction underflow component and a third solvent extraction overflow component. The third solvent extraction feed material may be comprised of the second solvent extraction underflow component. The third solvent extraction feed material may include a third stage amount of a diluent.

In some embodiments, attritioning the third solvent extraction feed material in the third solvent extraction stage may be comprised of mixing the third solvent extraction feed material in a third mixing apparatus.

In some embodiments, separating the attritioned third solvent extraction feed material in the third solvent extraction stage may be comprised of passing the attritioned third solvent extraction feed material through a third gravity settler. In some embodiments, the third gravity settler may be comprised of a third gravity settling vessel.

The third solvent extraction feed material has a solid mineral material concentration. The third solvent extraction feed material may have any solid mineral material concentration which is suitable for conducting the third solvent extraction stage. In some embodiments, the third solvent extraction feed material may have a solid mineral material concentration which is lower than a solid mineral material concentration which will interfere with the separation of bitumen from the third solvent extraction feed material. In some embodiments, the third solvent extraction feed material may have a solid mineral material concentration of at least about 20 percent by weight of the third solvent extraction feed material. In some embodiments, the third solvent extraction feed material may have a solid mineral material concentration of less than or equal to about 80 percent by weight of the third solvent extraction feed material. In some embodiments, the third solvent extraction feed material may have a solid mineral material concentration of less than or equal to about 70 percent by weight of the third solvent extraction feed material. In some embodiments, the third solvent extraction feed material may have a solid mineral material concentration of between about 20 percent and 70 percent by weight of the third solvent extraction feed material.

In some embodiments, the diluent may be comprised of or may consist essentially of a naphthenic type diluent such as naphtha and the third stage amount of the diluent may be at least about 15 percent by weight of the third solvent extraction feed material.

In some embodiments, the solvent extraction may consist essentially of the first solvent extraction stage, the second solvent extraction stage and the third solvent extraction stage. In such embodiments, the debitumenized heavy mineral concentrate may be comprised of or may consist essentially of the third solvent extraction underflow component. In such embodiments, the bitumen extract may be comprised of or may consist essentially of the first solvent extraction overflow component and/or the second solvent extraction overflow component and/or the third solvent extraction overflow component.

In some embodiments, the first solvent extraction stage, the second solvent extraction stage and the third solvent extraction stage may be arranged in a countercurrent configuration. In such embodiments, the bitumen extract may be comprised of or may consist essentially of the first solvent extraction overflow component. In such embodiments, the first solvent extraction feed material may be further comprised of the second solvent extraction overflow component and the second solvent extraction feed material may be further comprised of the third solvent extraction overflow component.

In some embodiments, the third solvent extraction stage may be further comprised of combining a recycled amount of a third solvent extraction intermediate component which is derived from the separating of the attritioned third solvent extraction feed material with the third solvent extraction feed material so that the third solvent extraction feed material is further comprised of the recycled amount of the third solvent extraction intermediate component.

The diluent may be comprised of a hydrocarbon diluent which is introduced to the solvent extraction and/or the diluent may be comprised of residual froth treatment diluent which is contained in the froth treatment tailings as a result of the froth treatment process. The hydrocarbon diluent may be introduced to the solvent extraction in any manner which is effective to provide a suitable amount of the diluent to the solvent extraction and/or the solvent extraction stages.

In some embodiments, the hydrocarbon diluent may consist essentially of a naphthenic type diluent. In some embodiments, the hydrocarbon diluent may be comprised of a naphthenic type diluent and may be further comprised of a paraffinic type diluent so that the hydrocarbon diluent is a mixture of a naphthenic type diluent and a paraffinic type diluent.

In some embodiments, the diluent (comprising the hydrocarbon diluent and the froth treatment diluent) may consist essentially of a naphthenic type diluent. In some embodiments, the diluent may be comprised of a naphthenic type diluent and may be further comprised of a paraffinic type diluent so that the diluent is a mixture of a naphthenic type diluent and a paraffinic type diluent.

In some embodiments, addition amounts of a naphthenic type diluent as a hydrocarbon diluent may be combined with the heavy mineral concentrate, the first solvent extraction underflow component, and/or the second solvent extraction underflow component.

In some embodiments in which the solvent extraction stages are arranged in a countercurrent configuration, subjecting the heavy mineral concentrate to solvent extraction may be comprised of combining an addition amount of a hydrocarbon diluent with the second solvent extraction underflow component so that the third solvent extraction feed material is comprised of the second solvent extraction underflow component and the addition amount of the hydrocarbon diluent. In some embodiments, the addition amount of the hydrocarbon diluent may be selected so that the first stage amount of the diluent is at least about 15 percent by weight of the first solvent extraction feed material.

The solvent extraction may be comprised of more than or fewer than three solvent extraction stages, depending upon the desired limit of the bitumen concentration of the debitumenized heavy mineral concentrate and upon the amount of bitumen which is contained in the heavy mineral concentrate.

In some embodiments in which the desired limit of the bitumen concentration of the debitumenized heavy mineral concentrate is about 0.5 percent by weight of the debitumenized heavy mineral concentrate, the solvent extraction may be comprised of at least three solvent extraction stages.

In some embodiments, an amount of bitumen in the heavy mineral concentrate which is greater than about 6 percent by weight of the heavy mineral concentrate may suggest that more than three solvent extraction stages may be necessary in order to achieve the desired limit of the bitumen concentration of the debitumenized heavy mineral concentrate, while an amount of bitumen in the heavy mineral concentrate which is less than 6 percent by weight of the heavy mineral concentrate may suggest that three solvent extraction stages may be sufficient in order to achieve the desired limit of the bitumen concentration of the debitumenized heavy mineral concentrate.

The method of the invention may be further comprised of recovering an amount of the diluent from the bitumen extract in order to produce a diluent recovered bitumen extract therefrom. Recovering the amount of the diluent from the bitumen extract may be achieved in any manner which is effective to reduce the diluent concentration of the bitumen extract and produce the diluent recovered bitumen extract.

In some embodiments, recovering an amount of the diluent from the bitumen extract may be comprised of passing the bitumen extract through a solvent recovery unit ("SRU") or similar apparatus.

The method of the invention may be further comprised of recovering an amount of the diluent from the debitumenized heavy mineral concentrate in order to produce a diluent recovered debitumenized heavy mineral concentrate therefrom. Recovering the amount of the diluent from the debitumenized heavy mineral concentrate may be achieved in any manner which is effective to reduce the diluent concentration of the debitumenized heavy mineral concentrate and produce the diluent recovered debitumenized heavy mineral concentrate.

In some embodiments, recovering an amount of the diluent from the debitumenized heavy mineral concentrate may be comprised of passing the debitumenized heavy mineral concentrate through a tailings solvent recovery unit ("TSRU") or similar apparatus.

In some embodiments, recovering an amount of the diluent from the debitumenized heavy mineral concentrate may be comprised of desliming the debitumenized heavy mineral concentrate to separate diluent (as well as water, small amounts of residual bitumen and small amounts of fine mineral material) from the debitumenized heavy mineral concentrate. In some embodiments, desliming the debitumenized heavy mineral concentrate may be comprised of passing the debitumenized heavy mineral concentrate through a desliming enhanced gravity separation apparatus. In some embodiments, the desliming enhanced gravity separation apparatus may be comprised of a hydrocyclone.

The debitumenized heavy mineral concentrate has a solid mineral material concentration. The debitumenized heavy mineral concentrate may have any solid mineral material concentration which is suitable for recovering the diluent from the debitumenized heavy mineral concentrate. In some embodiments, the debitumenized heavy mineral concentrate may have a solid mineral material concentration of between about 30 percent and about 70 percent by weight of the debitumenized heavy mineral concentrate in order to enhance the recovering of the amount of diluent therefrom. In some embodiments, the debitumenized heavy mineral concentrate may have a solid mineral material concentration of about 50 percent by weight of the debitumenized heavy mineral concentrate in order to enhance the recovering of the amount of diluent therefrom. In some embodiments, the solid mineral material concentration of the debitumenized heavy mineral concentrate may be adjusted by mixing an amount of water with the debitumenized heavy mineral concentrate.

In some embodiments, the method of the invention may be capable of producing a debitumenized heavy mineral concentrate which has a bitumen concentration which is no greater than about 0.5 percent by weight of the debitumenized heavy mineral concentrate. In some embodiments, the method of the invention may be capable of producing a debitumenized heavy mineral concentrate which has a bitumen concentration which is no greater than about 0.5 percent of the dry weight of the debitumenized heavy mineral concentrate, where the dry weight of the debitumenized heavy mineral concentrate is the weight of the debitumenized heavy mineral concentrate excluding water.

In some embodiments, the method of the invention may be capable of producing a bitumen extract which has a water concentration which is no greater than about 0.5 percent by weight of the bitumen extract. In some embodiments, the method of the invention may be capable of producing a bitumen extract which has a solid mineral material concentration which is no greater than about 0.5 percent by weight of the bitumen extract. In some embodiments, the method of the invention may be capable of producing a bitumen extract which has a combined solid mineral material and water concentration which is no greater than about 1.0 percent by weight of the bitumen extract, or in some embodiments no greater than about 0.5 percent by weight of the bitumen extract.

In some embodiments, the method of the invention may be capable of producing a diluent recovered debitumenized heavy mineral concentrate which has a bitumen concentration which is no greater than about 0.5 percent by weight of the diluent recovered debitumenized heavy mineral concentrate. In some embodiments, the method of the invention may be capable of producing a diluent recovered debitumenized heavy mineral concentrate which has a bitumen concentration which is no greater than about 0.5 percent of the dry weight of the diluent recovered debitumenized heavy mineral concentrate, where the dry weight of the diluent recovered debitumenized heavy mineral concentrate is the weight of the diluent recovered debitumenized heavy mineral concentrate excluding water.

In some embodiments, the method of the invention may be capable of producing a diluent recovered debitumenized heavy mineral concentrate which has a diluent concentration which is no greater than about 0.5 percent by weight of the diluent recovered debitumenized heavy mineral concentrate. In some embodiments, the method of the invention may be capable of producing a diluent recovered debitumenized heavy mineral concentrate which has a diluent concentration which is no greater than about 0.5 percent of the dry weight of the diluent recovered debitumenized heavy mineral concentrate, where the dry weight of the diluent recovered debitumenized heavy mineral concentrate is the weight of the diluent recovered debitumenized heavy mineral concentrate excluding water.

In some embodiments, the method of the invention may be capable of recovering in the heavy mineral concentrate at least about 90 percent of the heavy minerals which are contained in the coarse mineral material fraction by weight of the coarse mineral material fraction. In some embodiments, the method of the invention may be capable of recovering in the heavy mineral concentrate at least about 95 percent of the heavy minerals which are contained in the coarse mineral material fraction by weight of the coarse mineral material fraction. In some embodiments, the method of the invention may be capable of recovering in the heavy mineral concentrate at least about 80 percent of the bitumen which is contained in the coarse mineral material fraction by weight of the coarse mineral material fraction.

In some embodiments, the method of the invention may be capable of recovering in the bitumen extract at least about 80 percent of the bitumen which is contained in the coarse mineral material fraction by weight of the coarse mineral material fraction. In some embodiments, the method of the invention may be capable of recovering in the bitumen extract at least about 85 percent of the bitumen which is contained in the coarse mineral material fraction by weight of the coarse mineral material fraction. In some embodiments, the method of the invention may be capable of recovering at least about 90 percent of the bitumen which is contained in the coarse mineral material fraction by weight of the coarse mineral material fraction.

In some embodiments, the method of the invention may be capable of recovering in the diluent recovered debitumenized heavy mineral concentrate at least about 80 percent of the heavy minerals which are contained in the coarse mineral material fraction by weight of the coarse mineral material fraction. In some embodiments, the method of the invention may be capable of recovering in the diluent recovered debitumenized heavy mineral concentrate at least about 90 percent of the heavy minerals which are contained in the coarse mineral material fraction by weight of the coarse mineral material fraction.

BRIEF DESCRIPTION OF DRAWINGS

Embodiments of the invention will now be described with reference to the accompanying drawings, in which:

FIGS. 2*a*, 2*b* and 2*c* are a material balance for a bench scale test simulating the embodiment of the invention depicted in FIG. 1, and are referred to collectively herein as FIG. 2.

FIG. 3 is a material balance for a heavy mineral concentrate produced by a bench scale test simulating a froth flotation performed according to the embodiment of the invention depicted in FIG. 1, including a rougher froth flotation stage and a scavenger froth flotation stage.

DETAILED DESCRIPTION

In an exemplary embodiment, the present invention is comprised of a method for processing froth treatment tailings in order to produce a heavy mineral concentrate, a method for processing the heavy mineral concentrate in order to produce a debitumenized heavy mineral concentrate and a bitumen extract, and a method for processing the debitumenized heavy mineral concentrate in order to produce a recovered diluent and a diluent recovered debitumenized heavy mineral concentrate.

The production of the heavy mineral concentrate concentrates the heavy minerals and bitumen which are contained in the froth treatment tailings, while rejecting non-heavy minerals such as quartz as coarse mineral material tailings. The production of the debitumenized heavy mineral concentrate and the bitumen extract separates bitumen from the heavy minerals, thereby recovering the bitumen extract as a valuable bitumen product and recovering the debitumenized heavy mineral concentrate as a material which may be more amenable than the heavy mineral concentrate to mineral processing in order to recover heavy minerals therefrom. The production of the diluent recovered heavy mineral concentrate separates diluent from the debitumenized heavy mineral concentrate, thereby recovering the diluent for reuse and/or disposal and recovering the diluent recovered debitumenized heavy mineral concentrate as a material which may be even more amenable than the debitumenized heavy mineral concentrate to mineral processing in order to recover heavy minerals therefrom.

Figure 1:
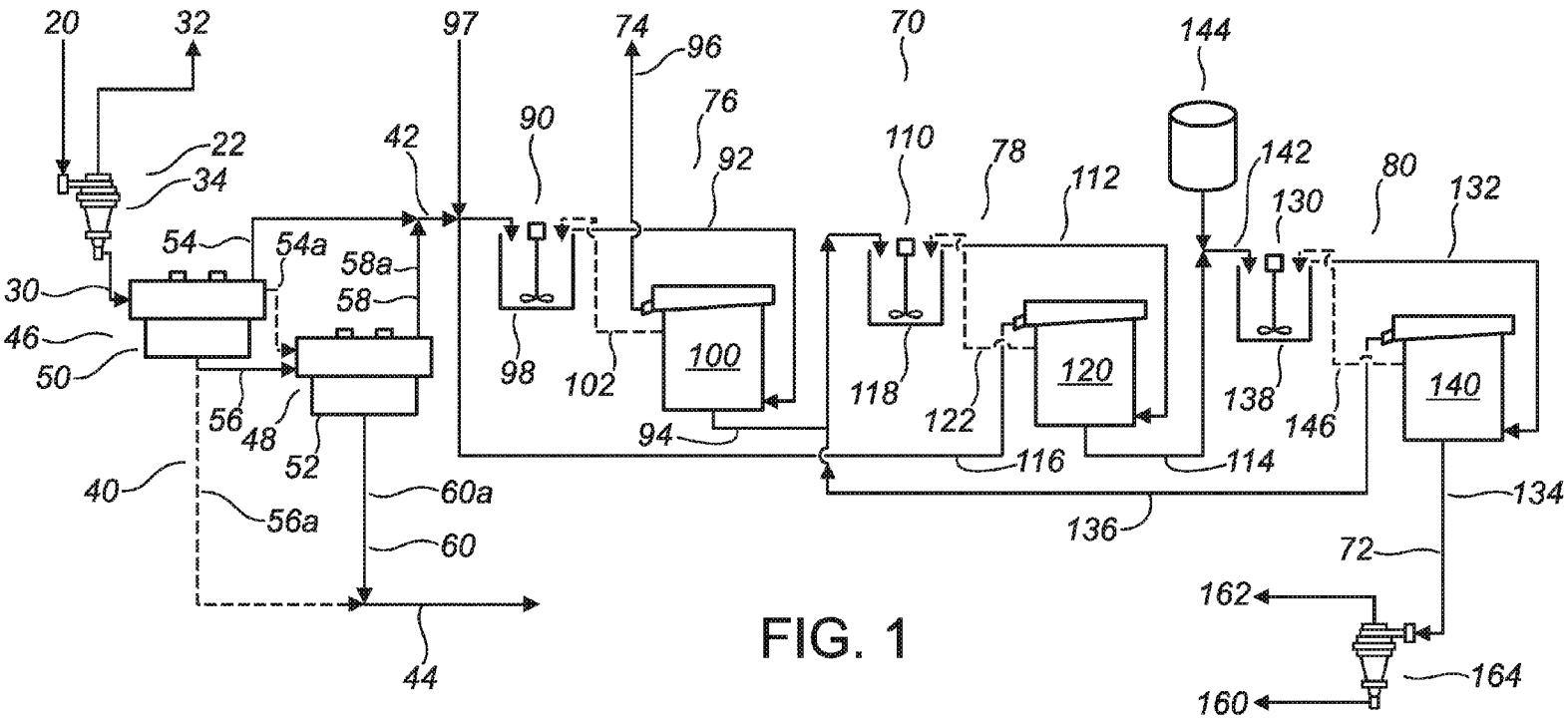
FIG. 1 is a schematic process flow diagram depicting an embodiment of the method of the invention, including depictions of alternate and/or optional features of the embodiment of the invention in dashed lines.

Referring to FIG. 1, an exemplary non-limiting embodiment of the method of the invention is depicted schematically in a process flow diagram.

A process for recovering bitumen from oil sand is comprised of producing a bitumen froth from the oil sand (not shown), and is further comprised of processing the bitumen froth in a froth treatment process (not shown) in order to separate froth treatment tailings (20) from the bitumen froth, thereby producing a bitumen product (not shown).

Typically, a relatively large amount of the heavy minerals which are originally present in the oil sand become concentrated in the froth treatment tailings (20) as a result of the processing of the oil sand. The froth treatment tailings (20) include coarse mineral material and fine mineral material. A large proportion of the heavy minerals in the froth treatment tailings (20) are typically present as coarse mineral material in the froth treatment tailings (20).

A purpose of the present invention is to facilitate the ultimate recovery of heavy minerals from the froth treatment tailings (20). The fine mineral material which is included in the froth treatment tailings (20) does not typically contain significant amounts of heavy minerals and may interfere with the recovery of the heavy minerals from the froth treatment tailings (20).

As a result, in the embodiment depicted in FIG. 1, the method of the invention is comprised of separating (22) the froth treatment tailings (20) in order to produce a coarse mineral material fraction (30) and a fine mineral material fraction (32).

The fine mineral material fraction (32) is not used in the method of the invention, but may be separately processed in order to recover bitumen therefrom (not shown). The coarse mineral material fraction (30) provides a conditioned feed material which is further processed in the method of the invention.

In the embodiment depicted in FIG. 1, separating (22) the froth treatment tailings (20) in order to produce the coarse mineral material fraction (30) and the fine mineral material fraction (32) is comprised of subjecting the froth treatment tailings (20) to enhanced gravity separation. More specifically, as depicted in FIG. 1, separating the froth treatment tailings (20) to produce the coarse mineral material fraction (30) and the fine mineral material fraction (32) is comprised of passing the froth treatment tailings (20) through an enhanced gravity separation apparatus (34) such as a hydrocyclone.

Following the separating (22) of the froth treatment tailings (20), the coarse mineral material fraction (30) is subjected to froth flotation (40) in order to produce a heavy mineral concentrate (42) and a coarse mineral material tailings (44) therefrom.

In the embodiment depicted in FIG. 1, the froth flotation (40) is comprised of a first froth flotation stage (46) and a second froth flotation stage (48). As depicted in FIG. 1, the first froth flotation stage (46) is performed in a first flotation vessel (50) and the second froth flotation stage (48) is performed in a second flotation vessel (52).

As depicted in FIG. 1, both the first froth flotation stage (46) and the second froth flotation stage (48) are performed in the presence of a suitable amount of an injected gas such as air (not shown) and in the presence of a suitable amount of a suitable frothing agent (not shown). Non-limiting examples of potentially suitable frothing agents include glycol based frothers and/or alcohol based frothers.

As a specific non-limiting example, in the embodiment depicted in FIG. 1, a suitable frothing agent may be Cytec™ F-507 frother, a product of Cytec Industries Inc., and may be added to the feed material to provide a frothing agent concentration of between about 15 grams and about 50 grams per tonne of feed material in each of the froth flotation stages (46,48).

The froth flotation stages (46,48) may be arranged in a scavenging configuration or in a cleaning configuration. The scavenging configuration of the froth flotation (40) is depicted by solid lines in FIG. 1. The cleaning configuration of the froth flotation (40) is depicted by dashed lines in FIG. 1.

In the scavenging configuration of the froth flotation (40), the first froth flotation stage (46) is a rougher froth flotation stage and the second froth flotation stage (48) is a scavenger froth flotation stage so that subjecting the coarse mineral material fraction (30) to froth flotation (40) is comprised of subjecting the coarse mineral material fraction (30) to the rougher froth flotation stage in order to produce a rougher stage float product (54) and a rougher stage sink product (56), and is further comprised of subjecting the rougher stage sink product (56) to the scavenger froth flotation stage in order to produce a scavenger stage float product (58) and a scavenger stage sink product (60).

In the scavenging configuration of the froth flotation (40) as depicted in FIG. 1, the rougher stage float product (54) and the scavenger stage float product (58) are combined so that the heavy mineral concentrate (42) is comprised of or consists essentially of the rougher stage float product (54) and the scavenger stage float product (58), and the coarse mineral material tailings (44) are comprised of or consist essentially of the scavenger stage sink product (60).

In the scavenging configuration of the froth flotation (40), subjecting the rougher stage sink product (56) to the scavenger froth flotation stage may be comprised of adding an amount of a collector (not shown) to the rougher stage sink product (56) in order to enhance the recovery of heavy minerals in the scavenger stage float product (54). In the embodiment of FIG. 1, the collector may be comprised of a hydrocarbon liquid such as kerosene, naphtha or a mixture thereof. It is believed that the collector adheres to heavy minerals which have amounts of bitumen attached thereto, thereby increasing the hydrophobicity and floatability of the heavy minerals.

In the scavenging configuration of the froth flotation (40) as depicted in FIG. 1, the rougher froth flotation stage and the scavenger froth flotation stage are performed so that the residence time of the coarse mineral material fraction in the rougher froth flotation stage is longer than the residence time of the rougher stage sink product in the scavenger froth flotation stage. For example, in some applications of the method of the invention, the residence time of the coarse mineral material fraction in the rougher froth flotation stage may be about 10 minutes and the residence time of the rougher stage sink product in the scavenger froth flotation stage may be about 5 minutes.

In the cleaning configuration of the froth flotation (40), the first froth flotation stage (46) is a rougher froth flotation stage and the second froth flotation stage (48) is a cleaner froth flotation stage so that subjecting the coarse mineral material fraction (30) to froth flotation (40) is comprised of subjecting the coarse mineral material fraction (30) to the rougher froth flotation stage in order to produce a rougher stage float product (54*a*) and a rougher stage sink product (56*a*), and is further comprised of subjecting the rougher stage float product (54*a*) to the cleaner froth flotation stage in order to produce a cleaner stage float product (58*a*) and a cleaner stage sink product (60*a*).

In the cleaning configuration of the froth flotation (40) as depicted in FIG. 1, the heavy mineral concentrate (42) is comprised of or consists essentially of the cleaner stage float product (58*a*). Furthermore, in the cleaning configuration of the froth flotation (40) as depicted in FIG. 1, the rougher stage sink product (56*a*) and the cleaner stage sink product (60*a*) are combined so that the coarse mineral material tailings (44) are comprised of or consist essentially of the rougher stage sink product (56*a*) and the cleaner stage sink product (60*a*).

In the embodiments of both the scavenging configuration and the cleaning configuration of the froth flotation (40) as described above, the coarse mineral material fraction (30) may have a solid mineral material concentration of between about 20 percent and about 80 percent by weight of the coarse mineral material fraction (30) when the coarse mineral material fraction (30) is introduced to the froth flotation (40) or more particularly, when the coarse mineral material fraction (30) is introduced to the first froth flotation stage (46).

A purpose of the froth flotation (40) is to concentrate the heavy minerals by rejecting the coarse mineral material tailings (44) in order to produce the heavy mineral concentrate (42). The heavy mineral concentrate (42) has a substantially smaller volume than the coarse mineral material fraction (30) and can therefore be processed more efficiently than the coarse mineral material fraction (30).

Following the froth flotation (40), the heavy mineral concentrate (42) is subjected to solvent extraction (70) in order to produce a debitumenized heavy mineral concentrate (72) and a bitumen extract (74) therefrom.

In the embodiment depicted in FIG. 1, the solvent extraction (70) is comprised of a first solvent extraction stage (76), a second solvent extraction stage (78) and a third solvent extraction stage (80).

As depicted in FIG. 1, the solvent extraction stages (76,78, 80) are arranged in a countercurrent configuration. As a result, the bitumen extract 74 is produced from the first solvent extraction stage (76) and the debitumenized heavy mineral concentrate (72) is produced. from the third solvent extraction stage (80).

The first solvent extraction stage (76) is comprised of attritioning a first solvent extraction feed material (90) in order to produce an attritioned first solvent extraction feed material (92). The first solvent extraction stage (76) is further comprised of separating the attritioned first solvent extraction feed material (92) in order to produce a first solvent extraction underflow component (94) and a first solvent extraction overflow component (96).

The first solvent extraction feed material (90) is comprised of the heavy mineral concentrate (42) and includes a first stage amount (not shown) of a diluent. In a specific application of the embodiment of FIG. 1, the diluent consists essentially of naphtha and the first stage amount of the diluent is at least about 15 percent by weight of the first solvent extraction feed material (90).

In the embodiment of FIG. 1, the diluent may be comprised of a hydrocarbon diluent which is added in the practice of the invention and/or the diluent may be comprised of a froth treatment diluent which was present in the froth treatment tailings (20) as a result of a froth treatment process.

In the embodiment of FIG. 1, the first solvent extraction feed material (90) may have a solid mineral material concentration of between about 20 percent and about 70 percent by weight of the first solvent extraction feed material (90). The first solvent extraction feed material (90) may be comprised of an amount of make-up water (97) to provide a desired solid mineral material concentration for the first solvent extraction feed material (90). The make-up water (97) may be comprised of or may consist essentially of fresh water and/or water which is recycled from the method of the invention or from other processes.

In the embodiment of FIG. 1, the attritioning of the first solvent extraction feed material (90) is performed by mixing the first solvent extraction feed material (90) in a first mixing apparatus (98). A purpose of the attritioning is to liberate bitumen from the heavy mineral concentrate (42) so that the bitumen can more effectively be separated from the heavy minerals in the separating of the attritioned first solvent extraction feed material (92). Another purpose of the attritioning is to mix the constituents of the first solvent extraction feed material (90).

In the embodiment of FIG. 1, the separating of the attritioned first solvent extraction feed material (92) is performed by passing the attritioned first solvent extraction feed material (92) through a first gravity settler (100). In the embodiment of FIG. 1, the first gravity settler (100) is comprised of a first gravity settling vessel.

In the embodiment of FIG. 1, the bitumen extract (74) is comprised of or consists essentially of the first solvent extraction overflow component (96). In the embodiment of FIG. 1, the first solvent extraction underflow component (94) is subjected to the second solvent extraction stage (78).

The second solvent extraction stage (78) is comprised of attritioning a second solvent extraction feed material (110) in order to produce an attritioned second solvent extraction feed material (112). The second solvent extraction stage (78) is further comprised of separating the attritioned second solvent extraction feed material (112) in order to produce a second solvent extraction underflow component (114) and a second solvent extraction overflow component (116).

The second solvent extraction feed material (110) is comprised of the first solvent extraction underflow component (94) and includes a second stage amount (not shown) of a diluent. In the embodiment of FIG. 1, the diluent consists essentially of naphtha. In the embodiment of FIG. 1, the second stage amount of the diluent is at least about 15 percent by weight of the second solvent extraction feed material (110). In the embodiment of FIG. 1, the diluent may be comprised of a hydrocarbon diluent which is added in the practice of the invention and/or the diluent may be comprised of a froth treatment diluent which was present in the froth treatment tailings (20).

In the embodiment of FIG. 1, the second solvent extraction feed material (110) may have a solid mineral material concentration of between about 20 percent and about 70 percent by weight of the second solvent extraction feed material (110).

In the embodiment of FIG. 1, the attritioning of the second solvent extraction feed material (110) is performed by mixing the second solvent extraction feed material (110) in a second mixing apparatus (118). A purpose of the attritioning is to liberate bitumen from the second solvent extraction feed material (110) so that the bitumen can more effectively be separated from the heavy minerals in the separating of the attritioned second solvent extraction feed material (112). Another purpose of the attritioning is to mix the constituents of the second solvent extraction feed material (110).

In the embodiment of FIG. 1, the separating of the attritioned second solvent extraction feed material (112) is performed by passing the attritioned second solvent extraction feed material (112) through a second gravity settler (120). In the embodiment of FIG. 1, the second gravity settler (120) is comprised of a second gravity settling vessel.

In the embodiment of FIG. 1, the second solvent extraction overflow component (116) is mixed with the heavy mineral concentrate (42) in the first mixing apparatus (98) so that the first solvent extraction feed material (90) is comprised of the second solvent extraction overflow component (116). In the embodiment of FIG. 1, the second solvent extraction underflow component (114) is subjected to the third solvent extraction stage (80).

The third solvent extraction stage (80) is comprised of attritioning a third solvent extraction feed material (130) in order to produce an attritioned third solvent extraction feed material (132). The third solvent extraction stage (80) is further comprised of separating the attritioned third solvent extraction feed material (132) in order to produce a third solvent extraction underflow component (134) and a third solvent extraction overflow component (136).

The third solvent extraction feed material (130) is comprised of the second solvent extraction underflow component (114) and includes a third stage amount (not shown) of a diluent. In the embodiment of FIG. 1, the diluent consists essentially of naphtha. In the embodiment of FIG. 1, the third stage amount of the diluent is at least about 15 percent by weight of the third solvent extraction feed material (130). In the embodiment of FIG. 1, the diluent may be comprised of a hydrocarbon diluent which is added in the practice of the invention and/or the diluent may be comprised of a froth treatment diluent which was present in the froth treatment tailings (20).

In the embodiment of FIG. 1, the third solvent extraction feed material (130) may have a solid mineral material concentration of between about 20 percent and about 70 percent by weight of the third solvent extraction feed material (130).

In the embodiment of FIG. 1, the attritioning of the third solvent extraction feed material (130) is performed by mixing the third solvent extraction feed material (130) in a third mixing apparatus (138). A purpose of the attritioning is to liberate bitumen from the third solvent extraction feed material (130) so that the bitumen can more effectively be separated from the heavy minerals in the separating of the attritioned third solvent extraction feed material (132). Another purpose of the attritioning is to mix the constituents of the third solvent extraction feed material (130).

In the embodiment of FIG. 1, the separating of the attritioned third solvent extraction feed material (132) is performed by passing the attritioned third solvent extraction feed material (132) through a third gravity settler (140). In the embodiment of FIG. 1, the third gravity settler (140) is comprised of a third gravity settling vessel.

In the embodiment of FIG. 1, the third solvent extraction overflow component (136) is mixed with the first solvent extraction underflow component (94) in the second mixing apparatus (118) so that the second solvent extraction feed material (110) is comprised of the third solvent extraction overflow component (136). In the embodiment of FIG. 1, the debitumenized heavy mineral concentrate (72) is comprised of or consists essentially of the third solvent extraction underflow component (134).

In the embodiment of FIG. 1, an addition amount (142) of a hydrocarbon diluent (144) is combined with the second solvent extraction underflow component (114) so that the third solvent extraction feed material (130) is comprised of the addition amount (142) of the hydrocarbon diluent. In the embodiment of FIG. 1, the hydrocarbon diluent (144) consists essentially of naphtha. In the embodiment of FIG. 1, the addition amount (142) of the hydrocarbon diluent (144) is selected so that the first stage amount of the diluent is at least about 15 percent by weight of the first solvent extraction feed material (90).

The solvent extraction (70) may optionally be further comprised of combining a recycled amount of an intermediate component which is derived from the solvent extraction feed material with the feed material so that the feed material is further comprised of the recycled amount of the intermediate component. A purpose of this optional feature is to dilute the solvent extraction feed material in order to enhance the separation of the feed material in the solvent extraction (70). This optional feature is depicted by dashed lines in FIG. 1. One or more of the solvent extraction stages (76,78,80) may be further comprised of this optional feature.

Referring to FIG. 1, a recycled amount of a first solvent extraction intermediate component (102) may optionally be combined with the heavy mineral concentrate (42) so that the first solvent extraction feed material (90) is further comprised of the recycled amount of the first solvent extraction intermediate component (102). The first solvent extraction intermediate component (102) is withdrawn from the first gravity settler (100) at a withdrawal point which is located below the level in the first gravity settler (100) where the first solvent extraction overflow component (96) accumulates and which is located above the level in the first gravity settler (100) where the first solvent extraction underflow component (94) accumulates. The recycled amount of the first solvent extraction intermediate component (102) may be any amount up to about 95 percent by weight of the portion of the first solvent extraction feed material (90) which is not comprised of the first solvent extraction intermediate component (102).

Also referring to FIG. 1, a recycled amount of a second solvent extraction intermediate component (122) may optionally be combined with the first solvent extraction underflow component (94) so that the second solvent extraction feed material (110) is further comprised of the recycled amount of the second solvent extraction intermediate component (122). The second solvent extraction intermediate component (122) is withdrawn from the second gravity settler (120) at a withdrawal point which is located below the level in the second gravity settler (120) where the second solvent extraction overflow component (116) accumulates and which is located above the level in the second gravity settler (120) where the second solvent extraction underflow component (114) accumulates. The recycled amount of the second solvent extraction intermediate component (122) may be any amount up to about 95 percent by weight of the portion of the second solvent extraction feed material (110) which is not comprised of the second solvent extraction intermediate component (122).

Also referring to FIG. 1, a recycled amount of a third solvent extraction intermediate component (146) may optionally be combined with the second solvent extraction underflow component (114) so that the third solvent extraction feed material (130) is further comprised of the recycled amount of the third solvent extraction intermediate component (146). The third solvent extraction intermediate component (146) is withdrawn from the third gravity settler (140) at a withdrawal point which is located below the level in the third gravity settler (140) where the third solvent extraction overflow component (136) accumulates and which is located above the level in the third gravity settler (140) where the third solvent extraction underflow component (134) accumulates. The recycled amount of the third solvent extraction intermediate component (146) may be any amount up to about 95 percent by weight of the portion of the third solvent extraction feed material (130) which is not comprised of the third solvent extraction intermediate component (146).

Following the solvent extraction (70), the bitumen extract (74) may be further processed and/or may be stored or transported for further processing. In bench scale simulation testing of the embodiment of FIG. 1 as described above, the bitumen extract (74) has been found typically to have a water concentration of no greater than about 0.5 percent by weight of the bitumen extract (74), to have a solid mineral material concentration of no greater than about 0.5 percent by weight of the bitumen extract (74), and to have a combined water and solid mineral material concentration of no greater than about 1.0 percent by weight of the bitumen extract (74) or in some cases no greater than about 0.5 percent by weight of the bitumen extract (74).

However, the bitumen extract (74) may have a diluent concentration of about 5 percent or more. As a result, it may be desirable to recover at least a portion of the diluent from the bitumen extract (74) in order to facilitate recycling of the diluent before processing, storing and/or transporting the bitumen extract (74).

As a result, the method of the invention may be further comprised of recovering an amount of the diluent from the bitumen extract (74) in order to produce a diluent recovered bitumen extract (not shown) and obtain a recovered diluent (not shown) therefrom.

Following the solvent extraction (70), the debitumenized heavy mineral concentrate (72) may be further processed to recover the heavy minerals which are contained therein. In bench scale simulation testing of the embodiment of FIG. 1 as described above, the debitumenized heavy mineral concentrate (72) has been found typically to have a bitumen concentration which is no greater than about 0.5 percent by weight of the debitumenized heavy mineral concentrate (72). It has also been found that a bitumen concentration of no greater than 0.5 percent does not typically interfere significantly with the recovery of heavy minerals from the debitumenized heavy mineral concentrate (72).

However, the debitumenized heavy mineral concentrate (72) may have a diluent concentration which is about 5 percent or more by weight of the debitumenized heavy mineral concentrate (72). It has been found that a diluent concentration of greater than about 0.5 percent may interfere significantly with the recovery of heavy minerals from the debitumenized heavy mineral concentrate (72). Consequently, it may be desirable to reduce the diluent concentration of the debitumenized heavy mineral concentrate (72) before attempting to recover the heavy minerals therefrom.

As a result, the method of the invention may be further comprised of recovering an amount of the diluent from the debitumenized heavy mineral concentrate (72) in order to produce a diluent recovered debitumenized heavy mineral concentrate (160) and obtain a recovered diluent (162) therefrom.

In the embodiment of FIG. 1, recovering an amount of the diluent from the debitumenized heavy mineral concentrate (72) is comprised of desliming the debitumenized heavy mineral concentrate (72) by passing the debitumenized heavy mineral concentrate (72) through a desliming enhanced gravity separation apparatus (164). As depicted in FIG. 1, the desliming enhanced gravity separation apparatus (164) is comprised of or consists essentially of a hydrocyclone.

In the embodiment of FIG. 1, recovering an amount of the diluent from the debitumenized heavy mineral concentrate (72) may if necessary be further comprised of mixing an amount of water with the debitumenized heavy mineral concentrate (72) so that the solid mineral material concentration of the debitumenized heavy mineral concentrate (72) is about 50 percent by weight of the debitumenized heavy mineral concentrate (72). The amount of water may be comprised of fresh water and/or water which is recycled from the method of the invention or from other processes.

In bench scale simulation testing of the embodiment of FIG. 1 as described above including desliming as described above, it has been found that the diluent recovered debitumenized heavy mineral concentrate (160) typically has a diluent concentration of less than about 0.5 percent by weight of the diluent recovered debitumenized heavy mineral concentrate (160). Furthermore, desliming the debitumenized heavy mineral concentrate (72) has typically resulted in a very significant recovery of water from the debitumenized heavy mineral concentrate (72) and in a recovery of a small amount of residual fine mineral material and a small amount of residual bitumen from the debitumenized heavy mineral concentrate (72).

Once a suitable bitumen concentration and a suitable diluent concentration have been attained in the debitumenized heavy mineral concentrate (72) or the diluent recovered debitumenized heavy mineral concentrate (160), as the case may be, the heavy minerals may be recovered using wet and/or dry mineral processing techniques. In some applications, the use of wet mineral processing techniques may be preferable for recovering the heavy minerals, since such techniques may avoid a need to dry the debitumenized heavy mineral concentrate (72) or the diluent recovered heavy mineral concentrate (160), as the case may be, before recovering the heavy minerals therefrom.

EXAMPLE 1

Referring to FIG. 2, a material balance is provided for a bench scale test simulating the embodiment of the invention depicted by the solid lines in FIG. 1. The material balance of FIG. 2 does not include a simulation of the alternate or optional features which are depicted by the dashed lines in FIG. 1. Consequently, in the material balance of FIG. 2, the froth flotation (40) is arranged in a scavenging configuration, and the solvent extraction (70) does not include recycling of the solvent extraction intermediate components (102,122,146).

In the bench scale test which is represented by FIG. 2, the solvent extraction (70) was performed by adding "fresh" naphtha as a hydrocarbon diluent in each of the three solvent extraction stages (76,78,80) instead of by recycling the overflow components (116,136) from the second and third solvent extraction stages (78,80) respectively. The overflow components (116,136) were, however, taken into consideration in calculating the material balance of FIG. 2. It is believed that the bench scale test represented by FIG. 2 provides a reasonably accurate simulation of the results which could be expected to be achieved if the solvent extraction stages (76, 78,80) were arranged in an actual countercurrent configuration.

Referring to FIG. 2, it is noted that the mass of the coarse mineral material fraction (30) was about 0.5000 kg and the mass of the heavy mineral concentrate was about 0.2750 kg, indicating that the froth flotation (40) was performed to achieve a mass float of about 55 percent from the coarse mineral material fraction (30).

Referring to FIG. 2, it is noted that the bitumen extract (74), consisting of the first solvent extraction overflow component (96), exhibited a water concentration of about 0.3500 percent by weight of the bitumen extract (74), exhibited a solid mineral material concentration of about 0.1000 percent by weight of the bitumen extract (74), and exhibited a combined water and solid mineral material concentration of about 0.4500 percent by weight of the bitumen extract (74).

Referring to FIG. 2, it is noted that the debitumenized heavy mineral concentrate (72), consisting of the third solvent extraction underflow component (134), exhibited a bitumen concentration of about 0.2041 percent by weight of the debitumenized heavy mineral concentrate (72), exhibited a diluent concentration of about 5.9475 percent by weight of the debitumenized heavy mineral concentrate (72), and exhibited a water concentration of about 44.1691 percent by weight of the debitumenized heavy mineral concentrate (72).

Referring to FIG. 2, it is noted that the debitumenized heavy mineral concentrate (72) contained about 99.9413 percent by weight of the solid mineral material which was contained in the heavy mineral concentrate (42), which even after allowing for experimental error (i.e., analytical precision/accuracy) suggests that none or very little of the heavy minerals which were contained in the heavy mineral concentrate (42) and which would be included in the solid mineral material were lost in the solvent extraction (70).

Referring to FIG. 2, it is noted that the bitumen extract (74) contained about 93 percent of the bitumen which was contained in the coarse mineral material fraction (30), indicating a bitumen recovery from the coarse mineral material fraction (30) of about 93 percent.

Referring to FIG. 2, it is noted that the diluent recovered debitumenized heavy mineral concentrate (160) exhibited a bitumen concentration of about 0.3270 percent by weight of the diluent recovered debitumenized heavy mineral concentrate (160), exhibited a diluent concentration of about 0.4359 percent by weight of the diluent recovered debitumenized heavy mineral concentrate (160), and exhibited a water concentration of about 8.2289 percent by weight of the diluent recovered debitumenized heavy mineral concentrate (160).

Referring to FIG. 2, it is noted that the diluent recovered debitumenized heavy mineral concentrate (160) contained about 97.9472 percent of the solid mineral material which was contained in the heavy mineral concentrate (42), suggesting that very little of the heavy minerals which were contained in the debitumenized heavy mineral concentrate (72) were lost in the recovery of the diluent from the debitumenized heavy mineral concentrate (72).

EXAMPLE 2

Referring to FIG. 3, a material balance is provided for a heavy mineral concentrate produced by a bench scale test simulating a froth flotation (40) performed according to the embodiment of FIG. 1, including a rougher froth flotation stage and a scavenger froth flotation stage.

Referring to FIG. 3, it is noted that about 97.5 percent of the total heavy minerals contained in the coarse mineral material fraction (30) were recovered in the heavy mineral concentrate (42), about 81.6 percent of the hydrocarbons contained in the coarse mineral material fraction (30) were recovered in the heavy mineral concentrate (42), about 97.5 percent of the $TiO_2$ values contained in the coarse mineral material fraction (30) were recovered in the heavy mineral concentrate (42), and about 99.1 percent of the $ZrO_2$ values contained in the coarse mineral material fraction were recovered in the heavy mineral concentrate (42).

EXAMPLE 3

Figure 4:
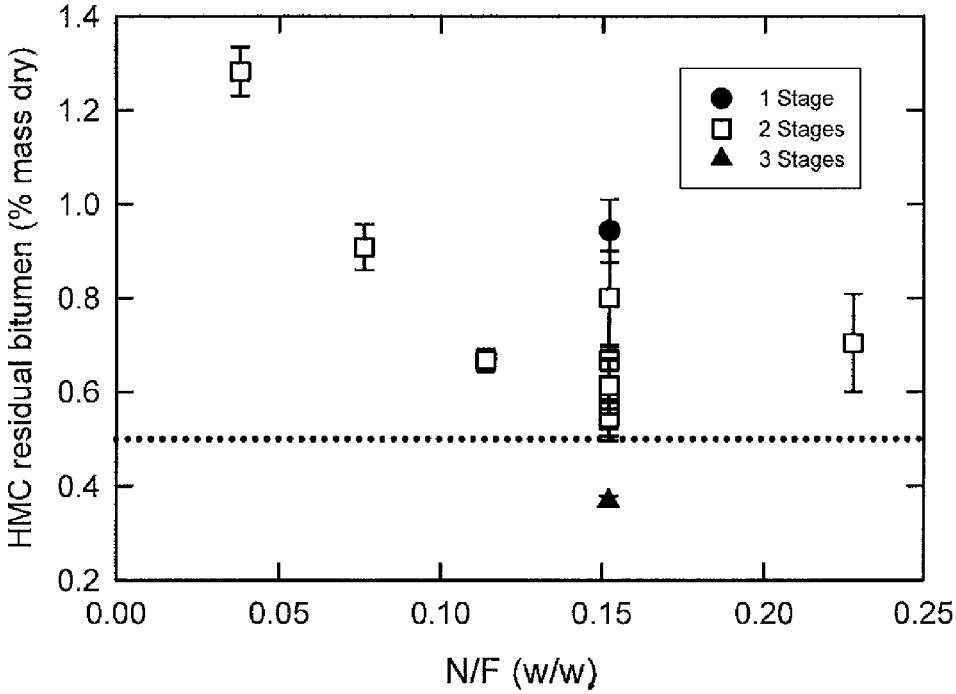
FIG. 4 is a graph of data obtained from bench scale tests of one stage, two stage, and three stage solvent extractions performed according to the invention at different diluent amounts in the feed material, depicting bitumen concentration of a debitumenized heavy mineral concentrate by dry weight of the debitumenized heavy mineral concentrate (i.e., excluding water) as a function of diluent amount and as a function of the number of solvent extraction stages.

Referring to FIG. 4, a graph is provided of data obtained from bench scale tests of one stage, two stage, and three stage solvent extractions (70) performed according to the invention a different diluent amounts in the feed material, depicting bitumen concentration of a debitumenized heavy mineral concentrate (72) by dry weight of the debitumenized heavy mineral concentrate (72) as a function of diluent amount and as a function of the number of solvent extraction stages.

Referring to FIG. 4, it is noted that a bitumen concentration of less than about 0.5 percent by dry weight of the debitumenized heavy mineral concentrate (72) was achieved by a three stage solvent extraction in which the diluent amount was at least 15 percent by weight of the feed material.

EXAMPLE 4

Figure 5:
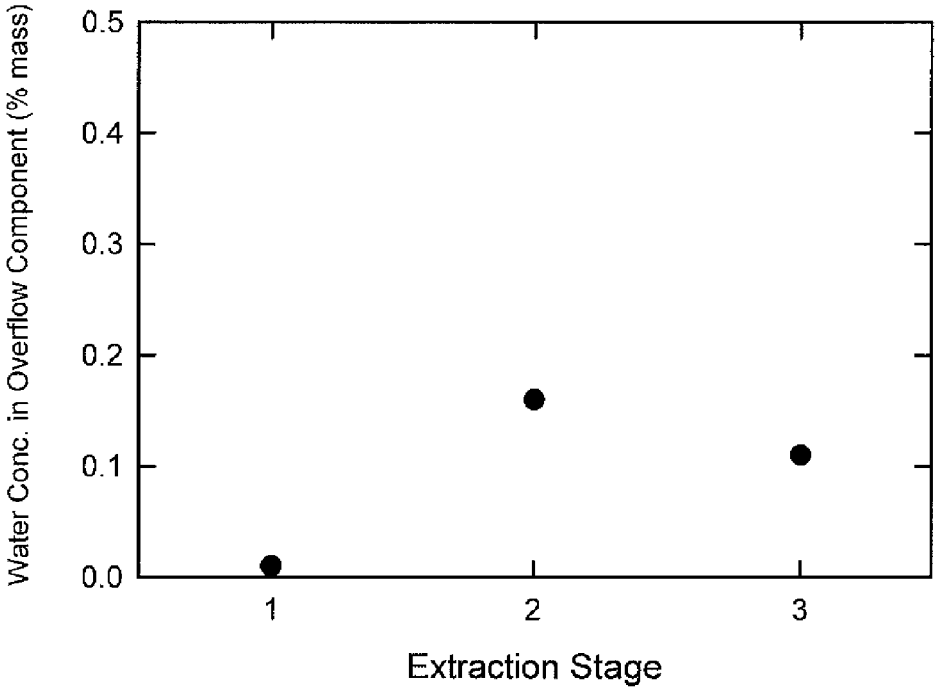
FIG. 5 is a graph of data obtained from bench scale tests of one stage, two stage, and three stage solvent extractions performed according to the invention at a diluent amount of 15 percent by weight of the feed material, depicting water concentration in the solvent extraction overflow components as a function of the number of stages of solvent extraction.

Referring to FIG. 5, a graph is provided of data obtained from bench scale tests of one stage, two stage and three stage solvent extractions performed according to the invention at a diluent amount of 15 percent by weight of the feed material, depicting water concentration in the solvent extraction overflow components as a function of the number of stages of solvent extraction, as measured by Karl Fischer titration techniques.

Referring to FIG. 5, it is noted that a water concentration of less than about 0.5 percent was achieved for each of the one stage, two stage and three stage solvent extractions.

In this document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be one and only one of the elements.

The embodiments of the invention in which an exclusive property or privilege is claimed are defined as follows:

1. A method for processing froth treatment tailings comprising solid mineral material, water, and bitumen, wherein the froth treatment tailings result from a process for recovering bitumen from oil sand, wherein the process for recovering bitumen from oil sand is comprised of producing a bitumen froth from the oil sand, wherein the process for recovering bitumen from oil sand is further comprised of separating the froth treatment tailings from the bitumen froth in a froth treatment process, the method comprising:

(a) separating the froth treatment tailings in order to produce a coarse mineral material fraction and a fine mineral material fraction therefrom;

(b) subjecting the coarse mineral material fraction to froth flotation in order to produce a heavy mineral concentrate and a coarse mineral material tailings therefrom; and (c) subjecting the heavy mineral concentrate to solvent extraction in order to produce a debitumenized heavy mineral concentrate and a bitumen extract therefrom, wherein the solvent extraction is comprised of a solvent extraction stage, wherein the solvent extraction stage is comprised of:

(i) attritioning a solvent extraction feed material in order to produce an attritioned solvent extraction feed material, wherein the solvent extraction feed material is comprised of the heavy mineral concentrate, and wherein the solvent extraction feed material includes an amount of a diluent;

(ii) separating the attritioned solvent extraction feed material in order to produce a solvent extraction underflow component and a solvent extraction overflow component; and (iii) combining a recycled amount of a solvent extraction intermediate component which is derived from the separating of the attritioned solvent extraction feed material with the solvent extraction feed material so that the solvent extraction feed material is further comprised of the recycled amount of the solvent extraction intermediate component, wherein the solvent extraction intermediate component is obtained from a withdrawal point which is located above the solvent extraction underflow component and below the solvent extraction overflow component.

2. The method as claimed in claim 1 wherein separating the froth treatment tailings is comprised of passing the froth treatment tailings through a tailings separation enhanced gravity separation apparatus.

3. The method as claimed in claim 2 wherein the tailings separation enhanced gravity separation apparatus is comprised of a hydrocyclone.

4. The method as claimed in claim 1 wherein subjecting the coarse mineral material fraction to froth flotation is comprised of producing the heavy mineral concentrate as a froth flotation float product and producing the coarse mineral material tailings as a froth flotation sink product.

5. The method as claimed in claim 1 wherein the froth flotation is comprised of a rougher froth flotation stage and a scavenger froth flotation stage so that subjecting the coarse mineral material fraction to froth flotation is comprised of subjecting the coarse mineral material fraction to the rougher froth flotation stage in order to produce a rougher stage float product and a rougher stage sink product and is further comprised of subjecting the rougher stage sink product to the scavenger froth flotation stage in order to produce a scavenger stage float product and a scavenger stage sink product.

6. The method as claimed in claim 5 wherein the heavy mineral concentrate is comprised of the rougher stage float product and the scavenger stage float product, further comprising combining the rougher stage float product and the scavenger stage float product to provide the heavy mineral concentrate.

7. The method as claimed in claim 5 wherein subjecting the rougher stage sink product to the scavenger froth flotation stage is comprised of adding an amount of a collector to the rougher stage sink product.

8. The method as claimed in claim 7 wherein the collector is comprised of a hydrocarbon liquid.

9. The method as claimed in claim 8 wherein the collector is selected from the group of hydrocarbon liquids consisting of kerosene, naphtha, and mixtures thereof.

10. The method as claimed in claim 1 wherein the froth flotation is comprised of a rougher froth flotation stage and a cleaner froth flotation stage so that subjecting the coarse mineral material fraction to froth flotation is comprised of subjecting the coarse mineral material fraction to the rougher froth flotation stage in order to produce a rougher stage float product and a rougher stage sink product and is further comprised of subjecting the rougher stage float product to the cleaner froth flotation stage in order to produce a cleaner stage float product and a cleaner stage sink product.

11. The method as claimed in claim 10 wherein the heavy mineral concentrate is comprised of the cleaner stage float product.

12. The method as claimed in claim 1 wherein the coarse mineral material fraction has a solid mineral material concentration and wherein the solid mineral material concentration of the coarse mineral material fraction is between 20 percent and 80 percent by weight of the coarse mineral material fraction when the coarse mineral material fraction is introduced to the froth flotation.

13. The method as claimed in claim 1 wherein the solvent extraction stage is a first solvent extraction stage, wherein the first solvent extraction stage is comprised of attritioning a first solvent extraction feed material in order to produce an attritioned first solvent extraction feed material, wherein the first solvent extraction stage is further comprised of separating the attritioned first solvent extraction feed material in order to produce a first solvent extraction underflow component and a first solvent extraction overflow component, wherein the first solvent extraction feed material is comprised of the heavy mineral concentrate, and wherein the first solvent extraction feed material includes a first stage amount of a diluent.

14. The method as claimed in claim 13 wherein attritioning the first solvent extraction feed material is comprised of mixing the first solvent extraction feed material in a first mixing apparatus.

15. The method as claimed in claim 13 wherein separating the attritioned first solvent extraction feed material is comprised of passing the first solvent extraction feed material through a first gravity settler.

16. The method as claimed in claim 15 wherein the first gravity settler is comprised of a first gravity settling vessel.

17. The method as claimed in claim 13 wherein the first solvent extraction feed material has a solid mineral material concentration and wherein the solid mineral material concentration of the first solvent extraction feed material is between 20 percent and 70 percent by weight of the first solvent extraction feed material.

18. The method as claimed in claim 13 wherein the diluent is comprised of a naphthenic type diluent.

19. The method as claimed in claim 18 wherein the naphthenic type diluent is comprised of naphtha.

20. The method as claimed in claim 18 wherein the first stage amount of the diluent is at least 15 percent by weight of the first solvent extraction feed material.

21. The method as claimed in claim 13 wherein the debitumenized heavy mineral concentrate is comprised of the first solvent extraction underflow component and wherein the bitumen extract is comprised of the first solvent extraction overflow component.

22. The method as claimed in claim 13 wherein the solvent extraction is further comprised of a second solvent extraction stage, wherein the second solvent extraction stage is comprised of attritioning a second solvent extraction feed material in order to produce an attritioned second solvent extraction feed material, wherein the second solvent extraction stage is further comprised of separating the attritioned second solvent extraction feed material in order to produce a second solvent extraction underflow component and a second solvent extraction overflow component, wherein the second solvent extraction feed material is comprised of the first solvent extraction underflow component, and wherein the second solvent extraction feed material includes a second stage amount of a diluent.

23. The method as claimed in claim 22 wherein attritioning the second solvent extraction feed material is comprised of mixing the second solvent extraction feed material in a second mixing apparatus.

24. The method as claimed in claim 22 wherein separating the attritioned second solvent extraction feed material is comprised of passing the second solvent extraction feed material through a second gravity settler.

25. The method as claimed in claim 24 wherein the second gravity settler is comprised of a second gravity settling vessel.

26. The method as claimed in claim 22 wherein the first solvent extraction feed material has a solid mineral material concentration and wherein the solid mineral material concentration of the first solvent extraction feed material is between 20 percent and 70 percent by weight of the first solvent extraction feed material.

27. The method as claimed in claim 22 wherein the diluent is comprised of a naphthenic type diluent.

28. The method as claimed in claim 27 wherein the naphthenic type diluent is comprised of naphtha.

29. The method as claimed in claim 27 wherein the first stage amount of the diluent is at least 15 percent by weight of the first solvent extraction feed material.

30. The method as claimed in claim 29 wherein the second stage amount of the diluent is at least 15 percent by weight of the second solvent extraction feed material.

31. The method as claimed in claim 22 wherein the first solvent extraction stage and the second solvent extraction stage are arranged in a countercurrent configuration.

32. The method as claimed in claim 31 wherein the debitumenized heavy mineral concentrate is comprised of the second solvent extraction underflow component and wherein the bitumen extract is comprised of the first solvent extraction overflow component.

33. The method as claimed in claim 32 wherein the first solvent extraction feed material is further comprised of the second solvent extraction overflow component.

34. The method as claimed in claim 22 wherein the second solvent extraction stage is further comprised of combining a recycled amount of a second solvent extraction intermediate component which is derived from the separating of the attritioned second solvent extraction feed material with the second solvent extraction feed material so that the second solvent extraction feed material is further comprised of the recycled amount of the second solvent extraction intermediate component.

35. The method as claimed in claim 22 wherein the solvent extraction is further comprised of a third solvent extraction stage, wherein the third solvent extraction stage is comprised of attritioning a third solvent extraction feed material in order to produce an attritioned third solvent extraction feed material, wherein the third solvent extraction stage is further comprised of separating the attritioned third solvent extraction feed material in order to produce a third solvent extraction underflow component and a third solvent extraction overflow component, wherein the third solvent extraction feed material is comprised of the second solvent extraction underflow component, and wherein the third solvent extraction feed material includes a third stage amount of a diluent.

36. The method as claimed in claim 35 wherein attritioning the third solvent extraction feed material is comprised of mixing the third solvent extraction feed material in a third mixing apparatus.

37. The method as claimed in claim 35 wherein separating the attritioned third solvent extraction feed material is comprised of passing the third solvent extraction feed material through a third gravity settler.

38. The method as claimed in claim 37 wherein the third gravity settler is comprised of a third gravity settling vessel.

39. The method as claimed in claim 35 wherein the first solvent extraction feed material has a solid mineral material concentration and wherein the solid mineral material concentration of the first solvent extraction feed material is between 20 percent and 70 percent by weight of the first solvent extraction feed material.

40. The method as claimed in claim 35 wherein the diluent is comprised of a naphthenic type diluent.

41. The method as claimed in claim 40 wherein the naphthenic type diluent is comprised of naphtha.

42. The method as claimed in claim 40 wherein the first stage amount of the diluent is at least 15 percent by weight of the first solvent extraction feed material.

43. The method as claimed in claim 42 wherein the second stage amount of the diluent is at least 15 percent by weight of the second solvent extraction feed material.

44. The method as claimed in claim 43 wherein the third stage amount of the diluent is at least 15 percent by weight of the third solvent extraction feed material.

45. The method as claimed in claim 35 wherein the first solvent extraction stage, the second solvent extraction stage, and the third solvent extraction stage are arranged in a countercurrent configuration.

46. The method as claimed in claim 45 wherein the debitumenized heavy mineral concentrate is comprised of the third solvent extraction underflow component and wherein the bitumen extract is comprised of the first solvent extraction overflow component.

47. The method as claimed in claim 46 wherein the first solvent extraction feed material is further comprised of the second solvent extraction overflow component and wherein the second solvent extraction feed material is further comprised of the third solvent extraction overflow component.

48. The method as claimed in claim 47 wherein subjecting the heavy mineral concentrate to solvent extraction is further comprised of combining an addition amount of a hydrocarbon diluent with the second froth flotation underflow component so that the third solvent extraction feed material is further comprised of the addition amount of the hydrocarbon diluent.

49. The method as claimed in claim 48 wherein the hydrocarbon diluent is comprised of a naphthenic type diluent.

50. The method as claimed in claim 49 wherein the naphthenic type diluent is comprised of naphtha.

51. The method as claimed in claim 49 wherein the addition amount of the hydrocarbon diluent is selected so that the first stage amount of the diluent is at least 15 percent by weight of the first solvent extraction feed material.

52. The method as claimed in claim 51 wherein the debitumenized heavy mineral concentrate has a bitumen concentration and wherein the bitumen concentration of the debitumenized heavy mineral concentrate is no greater than 0.5 percent by weight of the debitumenized heavy mineral concentrate.

53. The method as claimed in claim 49, further comprising recovering an amount of the diluent from the debitumenized heavy mineral concentrate in order to produce a diluent recovered debitumenized heavy mineral concentrate.

54. The method as claimed in claim 53 wherein recovering an amount of the diluentn from the debitumenized heavy mineral concentrate is comprised of desliming the debitumenized heavy mineral concentrate by passing the debitumenized heavy mineral concentrate through a desliming enhanced gravity separation apparatus.

55. The method as claimed in claim 54 wherein the desliming enhanced gravity separation apparatus is comprised of a hydrocyclone.

56. The method as claimed in claim 35 wherein the third solvent extraction stage is further comprised of combining a recycled amount of a third solvent extraction intermediate component which is derived from the separating of the attritioned third solvent extraction feed material with the third solvent extraction feed material so that the third solvent extraction feed material is further comprised of the recycled amount of the third solvent extraction intermediate component.

* * * * *

UNITED STATES PATENT AND TRADEMARK OFFICE

CERTIFICATE OF CORRECTION

PATENT NO. : 8,852,429 B2
APPLICATION NO. : 12/721991
DATED : October 7, 2014
INVENTOR(S) : Kevin Moran et al.

It is certified that error appears in the above-identified patent and that said Letters Patent is hereby corrected as shown below:

In the Claims,

Column 32, Line 63, (Claim 48, line 4), change “froth flotation” to --solvent extraction--.

Column 33, Line 18, (Claim 54, line 2), change “diluentn” to --diluent--.

Signed and Sealed this
Twenty-eighth Day of July, 2015

Michelle K. Lee

Michelle K. Lee
*Director of the United States Patent and Trademark Office*